US009704494B2

(12) United States Patent
Srinivasan et al.

(10) Patent No.: US 9,704,494 B2
(45) Date of Patent: Jul. 11, 2017

(54) DOWN-MIXING COMPENSATION FOR AUDIO WATERMARKING

(71) Applicant: The Nielsen Company (US), LLC, New York, NY (US)

(72) Inventors: Venugopal Srinivasan, Tarpon Springs, FL (US); Alexander Topchy, New Port Richey, FL (US)

(73) Assignee: The Nielsen Company (US), LLC, New York, NY (US)

( * ) Notice: Subject to any disclaimer, the term of this patent is extended or adjusted under 35 U.S.C. 154(b) by 0 days.

(21) Appl. No.: 15/282,433

(22) Filed: Sep. 30, 2016

(65) Prior Publication Data

US 2017/0018278 A1 Jan. 19, 2017

Related U.S. Application Data

(63) Continuation of application No. 14/800,376, filed on Jul. 15, 2015, which is a continuation of application (Continued)

(51) Int. Cl.
*G10L 19/018* (2013.01)
*G10L 19/008* (2013.01)

(52) U.S. Cl.
CPC ..... *G10L 19/018* (2013.01); *G10L 19/008* (2013.01)

(58) Field of Classification Search
None
See application file for complete search history.

(56) References Cited

U.S. PATENT DOCUMENTS 5,956,674 A 9/1999 Smyth et al.
6,240,121 B1 5/2001 Senoh (Continued)

FOREIGN PATENT DOCUMENTS

CN 101406074 4/2009
CN 101635146 1/2010

(Continued)

OTHER PUBLICATIONS

International Searching Authority, "International Preliminary Report on Patentability", issued in connection with International Patent Application No. PCT/US2014/020794, dated Sep. 24, 2015 (6 pages).

(Continued)

*Primary Examiner* — Paul Huber
(74) *Attorney, Agent, or Firm* — Hanley, Flight & Zimmerman, LLC

(57) ABSTRACT

Example methods, apparatus, systems and articles of manufacture to implement down-mixing compensation for audio watermarking are disclosed. Example watermark embedding methods disclosed herein include determining a first attenuation factor associated with a first audio channel of a multi-channel audio signal based on first down-mixed audio samples obtained from down-mixing the first audio channel and a second audio channel of the multi-channel audio signal, determining a second attenuation factor associated with a third audio channel of the multi-channel audio signal based on second down-mixed audio samples obtained from down-mixing the second audio channel and the third audio channel of the multi-channel audio signal, selecting one of the first attenuation factor or the second attenuation factor to be a third attenuation factor associated with the second audio channel of the multi-channel audio signal, and embedding a (Continued)

watermark in the second audio channel based on the third attenuation factor.

20 Claims, 12 Drawing Sheets

Related U.S. Application Data

No. 13/793,962, filed on Mar. 11, 2013, now Pat. No. 9,093,064.

(56) References Cited

U.S. PATENT DOCUMENTS

| | | | | |
|---|---|---|---|---|
| 7,088,844 | B2 | 8/2006 | Hannigan et al. | |
| 7,801,735 | B2 | 9/2010 | Thumpudi et al. | |
| 7,853,022 | B2 | 12/2010 | Thompson et al. | |
| 8,139,775 | B2 | 3/2012 | Hilpert et al. | |
| 8,160,258 | B2 | 4/2012 | Jung et al. | |
| 8,223,976 | B2 | 7/2012 | Purnhagen et al. | |
| 8,285,556 | B2 | 10/2012 | Jung et al. | |
| 8,351,645 | B2 | 1/2013 | Srinivasan | |
| 8,359,205 | B2 | 1/2013 | Srinivasan et al. | |
| 8,363,855 | B2 | 1/2013 | Griesinger | |
| 8,369,972 | B2 | 2/2013 | Topchy et al. | |
| 2005/0043830 | A1 | 2/2005 | Lee et al. | |
| 2006/0106620 | A1 | 5/2006 | Thompson et al. | |
| 2007/0270988 | A1 | 11/2007 | Goldstein et al. | |
| 2007/0297519 | A1 | 12/2007 | Thompson et al. | |
| 2008/0288263 | A1 | 11/2008 | Jung et al. | |
| 2010/0106510 | A1 | 4/2010 | Topchy et al. | |
| 2010/0106718 | A1 | 4/2010 | Topchy et al. | |
| 2010/0125453 | A1 | 5/2010 | Gibbs et al. | |
| 2011/0002470 | A1 | 1/2011 | Purnhagen et al. | |
| 2011/0022206 | A1 | 1/2011 | Scharrer et al. | |
| 2013/0051564 | A1 | 2/2013 | Baum et al. | |
| 2013/0227295 | A1* | 8/2013 | Wabnik | H04L 63/00 713/176 |
| 2014/0254801 | A1 | 9/2014 | Srinivasan et al. | |
| 2015/0317988 | A1 | 11/2015 | Srinivasan et al. | |

FOREIGN PATENT DOCUMENTS

| | | |
|---|---|---|
| CN | 102254561 | 11/2011 |
| WO | 2007110103 | 10/2007 |
| WO | 2009107054 | 9/2009 |
| WO | 2014164138 | 10/2014 |

OTHER PUBLICATIONS

ATSC, "ATSC Standard: Digital Audio Compression (AC-3), Revision A," Advanced Television Systems Committee, Aug. 20, 2001 (140 pages).

Davis, Mark F., "The AC-3 Multichannel Coder," Dolby Laboratories Inc., reproduced by permission of the Audio Engineering Society, Inc., 95th Convention, Oct. 7-10, 1993 (7 pages).

Harris Corporation, "DTS Neural Surround DownMix: 5.1 to Stereo," Signal Processing, Up/Downmix, Multimerge, Loudness Control, www.harrisbroadcast.com 2013 (2 pages).

Nielsen, "Product Notification: NAVE II and NAVE IIC Encoders," Nielsen Encoder Support, www.nielsen-encoder-forum.com, Mar. 31, 2010 (1 page).

International Searching Authority, "International Search Report & Written Opinion", issued in connection with International Application No. PCT/US2014/020794, mailed on Jun. 10, 2014 (9 pages).

United States Patent and Trademark Office, "Notice of Allowance", issued in connection with U.S. Appl. No. 13/793,962, dated Mar. 18, 2015 (7 pages).

Canadian Intellectual Property Office, "Office Action", issued in connection with Canadian Patent Application No. 2,875,367, dated Dec. 22, 2015 (4 pages).

United States Patent and Trademark Office, "Non-Final Office Action", issued in connection with U.S. Appl. No. 14/800,376, dated Mar. 15, 2016 (4 pages).

United States Patent and Trademark Office, "Notice of Allowance", issued in connection with U.S. Appl. No. 14/800,376, dated Jun. 23, 2016 (6 pages).

The State Intellectual Property Office of China, "Office Action", issued in connection with Chinese Patent Application No. 201480001433.7, dated Oct. 9, 2016 (11 pages).

European Patent Office, "European Search Report", issued in connection with European Patent Application No. 14778733.7, dated Sep. 23, 2016 (7 pages).

Swanson et al., "Current state of the art, challenges and future directions for audio watermarking", IEEE, 1999 (6 pages).

Linear Acoustic Inc., "Aeromax DTW Digital Television Audio Processor User Guide", Jun. 2007 (50 pages).

Canadian Intellectual Property Office, "Office Action", issued in connection with Canadian Patent Application No. 2,875,367, dated Nov. 22, 2016 (3 pages).

* cited by examiner

DOWN-MIXING COMPENSATION FOR AUDIO WATERMARKING

RELATED APPLICATION(S)

This patent arises from a continuation of U.S. patent application Ser. No. 14/800,376 (now U.S. Pat. No. 9,514,760), which is entitled "DOWN-MIXING COMPENSATION FOR AUDIO WATERMARKING" and which was filed on Jul. 15, 2015, which is a continuation of U.S. patent application Ser. No. 13/793,962 (now U.S. Pat. No. 9,093,064), which is entitled "DOWN-MIXING COMPENSATION FOR AUDIO WATERMARKING" and which was filed on Mar. 11, 2013. U.S. patent application Ser. No. 14/800,376 and U.S. patent application Ser. No. 13/793,962 are hereby incorporated by reference in their respective entireties.

FIELD OF THE DISCLOSURE

This disclosure relates generally to audio watermarking and, more particularly, to down-mixing compensation for audio watermarking.

BACKGROUND

Audio watermarks are embedded into host audio signals to carry hidden data that can be used in a wide variety of practical applications. For example, to monitor the distribution of media content and/or advertisements, such as television broadcasts, radio broadcasts, streamed multimedia content, etc., audio watermarks carrying media identification information can be embedded in the audio portion(s) of the distributed media. During a media presentation, the audio watermark(s) embedded in the audio portion(s) of the media can be detected by a watermark detector and decoded to obtain the media identification information identifying the presented media. In some scenarios, the media provided to a media device includes a multichannel audio signal, and the media device may down-mix at least some of the audio channels in the multichannel audio signal to yield a media presentation having fewer than the original number of audio channels. In such examples, the audio watermarks embedded in the audio channels may also be down-mixed when the media device down-mixes the audio channels.

BRIEF DESCRIPTION OF THE DRAWINGS

Wherever possible, the same reference numbers will be used throughout the drawing(s) and accompanying written description to refer to the same or like parts, elements, etc.

DETAILED DESCRIPTION

Figure 1:
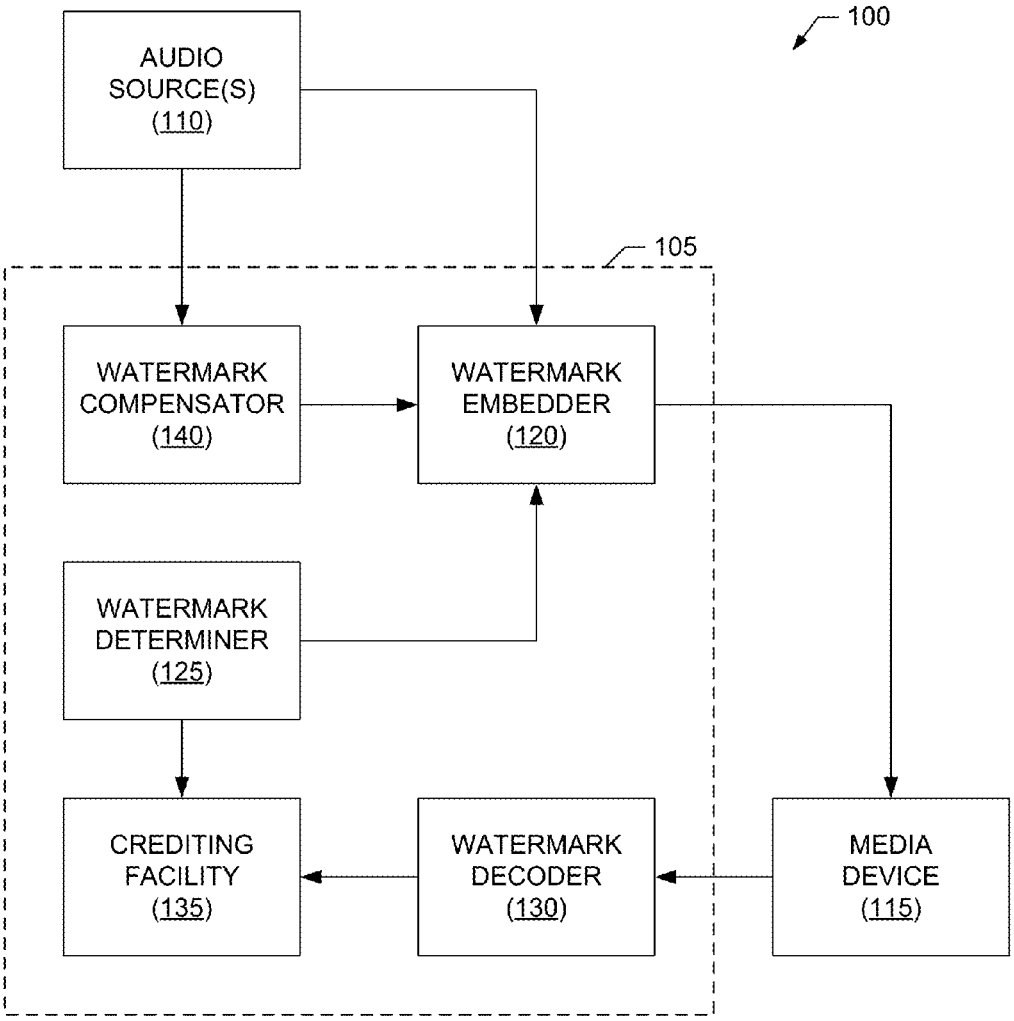
FIG. 1 is a block diagram of an example media monitoring system employing down-mixing compensation for audio watermarking as disclosed herein.

Example methods, apparatus, systems and articles of manufacture (e.g., physical storage media) to implement down-mixing compensation for audio watermarking are disclosed herein. Example methods disclosed herein to compensate for audio channel down-mixing when embedding watermarks in a multichannel audio signal include obtaining a watermark to be embedded in respective ones of a plurality of audio channels of the multichannel audio signal. Such example methods also include embedding the watermark in a first one of the plurality of audio channels based on a compensation factor that is to reduce perceptibility of the watermark when the first one of the plurality of audio channels is down-mixed with a second one of the plurality of audio channels after the watermark has been applied to the first and second ones of the plurality of audio channels. For example, the multichannel audio signal may include a front left channel, a front right channel, a center channel, a rear left channel and a rear right channel. In such examples, the watermark may be embedded in, for example, at least one of the front left channel, the front right channel or the center channel based on the compensation factor.

Some example methods further include determining the compensation factor based on evaluating the first and second ones of the plurality of audio channels. In some such example methods, the compensation factor corresponds to an attenuation factor for a first audio band, and determining the compensation factor includes determining the attenuation factor for the first audio band. For example, the attenuation factor can be based on a ratio of a first energy and a second energy determined for the first audio band. In some such examples, the first energy corresponds to an energy in the first audio band for a first block of down-mixed audio samples formed by down-mixing the first one of the plurality of audio channels with the second one of the plurality of audio channels, and the second energy corresponds to a maximum of a plurality of energies determined for a respective plurality of blocks of down-mixed audio samples including the first block of down-mixed audio samples. Some such examples also include applying the attenuation factor to the watermark when embedding the watermark in the first one of the plurality of audio channels, and applying the attenuation factor to the watermark when embedding the watermark in the second one of the plurality of audio channels. Furthermore, in some examples, such as when the multichannel audio signal includes at least three audio channels, the attenuation factor is determined using the down-mixed audio samples formed by down-mixing the first one of the plurality of audio channels with the second one of the plurality of audio channels, and the example methods further include applying the attenuation factor to the watermark when embedding the watermark in a third one of the plurality of audio channels different from the first and second ones of the plurality of audio channels.

Additionally or alternatively, in some example methods, the compensation factor includes a decision factor indicating whether the watermark is permitted to be embedded in a first block of audio samples from the first one of the plurality of audio channels. In such example methods, determining the compensation factor can include determining a delay between the first block of audio samples from the first one of the plurality of audio channels and a second block of audio samples from the second one of the plurality of audio channels, with the first and second blocks of audio samples corresponding to a same interval of time. Such example methods can also include setting the decision factor to indicate embedding of the watermark in the first block of audio samples from the first one of the plurality of audio channels is not permitted when the delay is in a first range of delays. However, such example methods can further include setting the decision factor to indicate embedding of the watermark in the first block of audio samples from the first one of the plurality of audio channels is permitted when the delay is not in the first range of delays.

Additionally or alternatively, in some example methods, embedding the watermark in the first one of the plurality of audio channels based on the compensation factor includes applying a phase shift to the watermark when embedding the watermark in the first one of the plurality of audio channels. In such examples, the watermark may be embedded in the second one of the plurality of audio channels without the phase shift being applied to the watermark.

These and other example methods, apparatus, systems and articles of manufacture (e.g., physical storage media) to implement down-mixing compensation for audio watermarking are disclosed in greater detail below.

Media, including media content and/or advertisements, may include multichannel audio signals, such as the industry-standard 5.1 and 7.1 encoded audio signals supporting one (1) low frequency channel and five (5) or seven (7) full frequency channels, respectively. As mentioned above, a media device presenting media having a multichannel audio signal may down-mix at least some of the audio channels to yield fewer audio channels for presentation. For example, the media device may down-mix the left, center and right audio channels of a 5.1 multichannel audio signal to yield a two-channel stereo signal having a left stereo channel and a right stereo channel. In such examples, if watermarks are embedded in the original channels (e.g., the left, center and right audio channels) of the multichannel audio signal, then the watermarks will also be down-mixed when the media portions of these audio channels are down-mixed.

The resulting amplitudes of the media portions of the down-mixed audio channels (e.g., the left and right stereo channels) can depend on the relative phase differences and/or time delays between the original audio channels (e.g., the left, center and right audio channels of the 5.1 multichannel audio signal) being down-mixed. For example, if the relative phase difference and/or time delay between the left and center audio channels of the 5.1 multichannel audio signal causes these channels to be destructively combined during the down-mixing procedure, then the left stereo channel resulting from the down-mixing procedure may have a lower amplitude than the original left and center channel audio signals. However, if the watermarks in each audio channel are embedded such that there is little (or no) relative phase difference and/or time delay between the watermarks embedded in different channels, then the watermarks in the different channels may be constructively combined during the down-mixing procedure, thereby increasing the amplitude of the watermark in the down-mixed audio channel. Accordingly, in some scenarios, such as when the amplitude of the media portion of the down-mixed audio signal is reduced through the down-mixing procedure, audio watermarks that were not perceptible in the original, multichannel audio signal may become perceptible (e.g., audible) in the resulting down-mixed audio signal(s).

Disclosed example methods, apparatus, systems and articles of manufacture (e.g., physical storage media) can reduce the perceptibility of such down-mixed audio watermarks by providing down-mixing compensation during watermarking of the multichannel audio signal. Some examples of down-mixing compensation for audio watermarking disclosed herein involve determining one or more attenuation factors to be applied to a watermark when embedding the watermark in a channel of a multichannel audio signal. For example, different attenuation factors, or the same watermark attenuation factor, can be determined and used for some or all of the audio channels included in the multichannel audio signal. Also, different attenuation factors, or the same watermark attenuation factor, can be determined and used for watermark attenuation in different frequency subbands of a particular audio channel included in the multichannel audio signal. Additionally or alternatively, some examples of down-mixing compensation for audio watermarking disclosed herein involve introducing a phase shift to a watermark applied to one or more of the audio channels of the multichannel audio signal, while not applying a phase shift to one or more other channels of the multichannel audio signal. Additionally or alternatively, some examples of down-mixing compensation for audio watermarking disclosed herein involve disabling audio watermarking in the multichannel audio signal for a block of audio when a time delay between two audio channels that can down-mixed is determined to be within a range of delays that may cause the watermark embedded in the two audio channels to become perceptible after down-mixing. Combinations of the foregoing down-mixing compensation examples are also possible, as described in greater detail below.

Turning to the figures, a block diagram of an example environment of use 100 including an example media monitoring system 105 employing down-mixing compensation for audio watermarking as disclosed herein is illustrated in FIG. 1. In the illustrated example of FIG. 1, one or more audio sources, such as the example audio source 110, provide audio for presentation by one or more media devices, such as the example media device 115. For example, the audio source 110 can correspond to any audio portion of media provided to the media device 115. As such, the audio source 110 can correspond to audio content (e.g., such as a radio broadcast, audio portion(s) of a television broadcast, audio portion(s) of streaming media content, etc.) and/or audio advertisements included in media distributed to or otherwise made available for presentation by the media device 115. The media device 115 of the illustrated example can be implemented by any number, type(s) and/or combination of media devices capable of presenting audio. For example, the media device 115 can be implemented by any television, set-top box (STB), cable and/or satellite receiver, digital multimedia receiver, gaming console, personal computer, tablet computer, personal gaming device, personal digital assistant (PDA), digital video disk (DVD) player, digital video recorder (DVR), personal video recorder (PVR), cellular/mobile phone, etc.

In the illustrated example, the media monitoring system 105 employs audio watermarks to monitor media provided to and presented by media devices, including the media device 115. Thus, the example media monitoring system 105 includes an example watermark embedder 120 to embed information, such as identification codes, in the form of audio watermarks into the audio sources, such as the audio source 110, capable of being provided to the media device 115. Identification codes, such as watermarks, ancillary codes, etc., may be transmitted within media signals, such as the audio signal(s) transmitted by the audio source 110. Identification codes are data that are transmitted with media (e.g., inserted into the audio, video, or metadata stream of media) to uniquely identify broadcasters and/or media (e.g., content or advertisements), and/or are associated with the media for another purpose such as tuning (e.g., packet identifier headers ("PIDs") used for digital broadcasting). Codes are typically extracted using a decoding operation.

In contrast, signatures are a representation of some characteristic of the media signal (e.g., a characteristic of the frequency spectrum of the signal). Signatures can be thought of as fingerprints. They are typically not dependent upon insertion of identification codes in the media, but instead preferably reflect an inherent characteristic of the media and/or the signal transporting the media. Systems to utilize codes and/or signatures for audience measurement are long known. See, for example, Thomas, U.S. Pat. No. 5,481,294, which is hereby incorporated by reference in its entirety.

In the illustrated example, the payload data to be included in the watermark(s) to be embedded by the watermark embedder 120 are determined or otherwise obtained by an example watermark determiner 125. For example, the payload data determined by the watermark determiner 125 can include content identifying payload data to identify the media corresponding to the audio signal(s) provided by the audio source 110. Such content identifying payload data can include a name of the media, a source/distributor of the media, etc. For example, in the case of television programming monitoring, the payload data may include an identification number (e.g., a station identifier (ID), or SID) representing the identity of a broadcast entity, and a timestamp denoting an instant of time in which the watermark containing the identification number was inserted in the audio portion of the telecast. The combination of the identification number and the timestamp can be used to identify a particular television program broadcast by the broadcast entity at a particular time. Additionally or alternatively, the payload data determined by the watermark determiner 125 can include, for example, authorization data for use in digital rights management and/or copy protection applications.

In the illustrated example, the watermark embedder 120 obtains the watermark payload data containing content marking or identification information, or any other suitable information, from the watermark determiner 125. The watermark embedder 120 then generates an audio watermark based on the payload data obtained from the watermark determiner 125 using any audio watermark generation technique. For example, the watermark embedder 120 can use the obtained watermark payload data to generate an amplitude and/or frequency modulated watermark signal having one or more frequencies that are modulated to convey the watermark. Furthermore, the watermark embedder 120 embeds the generated watermark signal in an audio signal from the audio source 110, which is also referred to as the host audio signal, such that the watermark signal is hidden or, in other words, rendered imperceptible to the human ear by the psycho-acoustic masking properties of the host audio signal. One such example audio watermarking technique for generating and embedding audio watermarks, which can be implemented by the example watermark embedder 120, is disclosed by Topchy et al. in U.S. Patent Publication No. 2010/0106510, which was published on Apr. 29, 2010, and is incorporated herein by reference in its entirety. When implementing that example technique, the watermark signal generated and embedded by the watermark embedder 120 includes a set of six (6) sine waves, also referred to as code frequencies, ranging in frequency between 3 kHz and 5 kHz. The code frequencies (e.g., sine waves) of the watermark signal are embedded in respective audio frequency bands (also referred to as critical bands) of a long block of 9,216 audio samples created by sampling the host audio signal from the audio source 115 with a clock frequency of 48 kHz. Furthermore, successive long blocks of the host audio can be encoded with successive watermark signals to convey more payload data than can fit in a single long block of audio, and/or to convey successive watermarks containing the same or different payload data.

To embed the watermark signal in a particular long block of host audio according to the foregoing example watermarking technique, the watermark embedder 120 divides the long block into 36 short blocks each containing 512 samples and having an overlap of 256 samples from a respective previous short block. Furthermore, to hide the embedded watermark signal in the host audio, the watermark embedder 120 varies the respective amplitudes of the watermark code frequencies from one short block to the next short block based on the masking energy provided by the host audio. For example, if a short block of the host audio has energy E(b) in an audio frequency band b, then the watermark embedder 120 computes a local amplitude of the code frequency to be embedded in that audio frequency band as $\sqrt{k_m(b)E(b)}$, where $k_m(b)$ is a masking ratio determined, specified or otherwise associated with the critical band b. Accordingly, different audio frequency bands may have different masking ratios, and the watermark embedder 120 may determine different local amplitudes for the different code frequencies to be embedded in different audio frequency bands.

Other examples of audio watermarking techniques that can be implemented by the watermark embedder 120 include, but are not limited to, the examples described by Srinivasan in U.S. Pat. No. 6,272,176, which issued on Aug. 7, 2001, in U.S. Pat. No. 6,504,870, which issued on Jan. 7, 2003, in U.S. Pat. No. 6,621,881, which issued on Sep. 16, 2003, in U.S. Pat. No. 6,968,564, which issued on Nov. 22, 2005, in U.S. Pat. No. 7,006,555, which issued on Feb. 28, 2006, and/or the examples described by Topchy et al. in U.S. Patent Publication No. 2009/0259325, which published on Oct. 15, 2009, all of which are hereby incorporated by reference in their respective entireties.

To detect and decode the watermarks embedded by the watermark embedder 120 in the audio source 110, the media monitoring system 105 includes an example watermark decoder 130. In the illustrated example, the watermark decoder 130 detects audio watermarks that were embedded or otherwise encoded by the watermark embedder 120 in the media presented by the media device 115. For example, the watermark decoder 130 may access the audio presented by the media device 115 through physical (e.g., electrical) connections with the speakers of the media device 115, and/or with an audio line output (if available) of the media device 115. The audio can additionally or alternatively be captured using a microphone placed in the vicinity of the media device 115. In some examples, such as in media monitoring and/or audience measurement applications, the watermark decoder 130 can further decode and store the payload data conveyed by the detected watermarks for reporting to an example crediting facility 135 for further processing and analysis. For example, the crediting facility 135 of the illustrated example media monitoring system 105 may process the detected audio watermarks and/or decoded watermark payload data reported by the watermark decoder 130 to determine what media was presented by the media device 115 during a measurement reporting interval.

As noted above, the audio signal(s) provided by the audio source 110 may include multiple audio channels, such as the industry-standard 5.1 and 7.1 encoded audio signals supporting one (1) low frequency channel and five (5) or seven (7) full frequency channels, respectively. Furthermore, some media devices, such as the media device 115 of the illustrated example, may perform down-mixing to mix some or all of the audio channels in a received multichannel audio signal to yield a media presentation having few audio channels than in the original multichannel audio signal. To be able to compensate for down-mixing that can occur at a media device, such as the media device 115, the example media monitoring system 105 includes an example watermark compensator 140 which, in conjunction with the watermark embedder 120, can provide down-mixing compensation for audio watermarking as described in greater detail below.

For example, in the case of 5.1 multichannel audio signal supporting surround sound system, watermark signals may be embedded by the watermark embedder 120 in some or all of the five (5) full bandwidth channels, including the front left (L) channel, the front right (R) channel, the center (C) channel, the rear left surround ($L_s$) channel, and/or the rear right surround ($R_s$) channel. In the following, the symbols L, R, C, $L_s$ and $R_s$ are also used to represent the time domain amplitudes of these respective audio channels. The low frequency effects (LFE) channel represented by the "0.1" symbol in 5.1 label for the multichannel audio signal typically does not support a watermark because its masking energy is limited to frequencies below 100 Hz. In examples in which the watermark signal includes a set of code frequencies (e.g., sine waves), the watermark embedder 120 may embed the same watermark signal in some or all of the audio channels and, further, such that the code frequencies are inserted in-phase in some or all of the channels. Embedding watermarks in some or all of the audio channels of a multichannel audio signal makes it possible for the watermark decoder 130 to extract a watermark even when some or all of the audio channels are down-mixed by the media device 115 (e.g., to enable the media to presented in environments that do not include equipment capable of presenting the full 5.1 channel audio). For example, if the media device 115 has only two built-in stereo speakers, or is otherwise communicatively coupled to only two stereo speakers, then the media device 115 may convert a 5.1 multichannel channel audio broadcast to two (2) down-mixed stereo audio channels, referred to herein as the left stereo channel ($L_t$) and the right stereo channel ($R_t$). Furthermore, embedding the watermark signals in-phase in the different audio channel can enhance the watermark in the resultant down-mixed audio. However, the audio portions of the resultant down-mixed audio may not be enhanced like the watermark, thereby causing the watermark to be perceptible in the down-mixed audio presentation.

For example, there are several possible techniques by which the media device 115 can down-mix 5.1 channel audio for presentation by a 2-speaker system or a 3-speaker system. One such example technique involves ignoring the rear surround channels and distributing the energy of the center channel equally between the left and right channels according to the following equations:

$$L_t = L + 0.707C \quad \text{Equation 1}$$

and $$R_t = R + 0.707C \quad \text{Equation 2}$$

When audio is down-mixed, the masking energy in one or more of the critical frequency bands of the resulting down-mixed signal might decrease such that the watermark signal is no longer masked and becomes perceptible.

For example, consider the case of mixing the left and center channels according to Equation 1 to yield the left stereo channel. To simplify matters, the factor of 0.707 in Equation 1 will be ignored in the following. In the case of multichannel audio that is identical in waveform in the left and center channels (but may have different amplitudes), and is also in-phase between the two channels, the energy in a critical band b of the down-mixed audio is a maximum given by the following equation:

$$E_{max(L+C)}(b) = E_L(b) + E_C(b) + 2\sqrt{E_L(b)E_C(b)} \quad \text{Equation 3}$$

In Equation 3, $E_L(b)$ represents the energy in the critical band b of the left channel, $E_C(b)$ represents the energy in the critical band b of the center channel, and $E_{max(L+C)}(b)$ represents the maximum energy in the down-mixed left and center channels. However, if the left and center channels are identical in waveform, but inverted in phase, then the energy in the critical band b of the down-mixed audio is a minimum given by the following equation:

$$E_{min(L+C)}(b) = E_L(b) + E_C(b) - 2\sqrt{E_L(b)E_C(b)} \quad \text{Equation 4}$$

In Equation 4, $E_{min(L+C)}(b)$ represents the minimum energy in the down-mixed left and center channels. In other cases in which the left and center audio channels are partially correlated, the energy in the critical band b of the down-mixed audio will lie between the two extremes of Equation 3 and Equation 4. However, when the watermark signals are embedded in phase in the left and right channels, the energy of the down-mixed watermark signals may be maximum (due to the in-phase embedding among channels), whereas the down-mixed audio may be closer to its minimum of Equation 4, thereby reducing the masking ability of the down-mixed audio relative to the enhanced down-mixed watermark. This decrease in masking capability can be especially noticeable in the case of live programming where microphones for different audio channels are placed at different locations and, thus, capture sounds (e.g., applause or laughter) that tend to be uncorrelated at the different microphone locations. As described in greater detail below, the watermark compensator 140, in conjunction with the watermark embedder 120, implements one or more, or a combination of, down-mixing compensation techniques targeted at reducing the perceptibility of audio watermarks in down-mixed audio signals.

Although the example environment of use 100 of FIG. 1 includes one media device 115, one watermark embedder 120, one watermark determiner 125, one watermark decoder 130, one crediting facility 135 and one watermark compensator 140, down-mixing compensation for audio watermarking as disclosed herein can be used with any number(s) of media devices 114, watermark embedders 120, watermark determiners 125, watermark decoders 130, crediting facilities 135 and/or watermark compensators 140. Also, although the watermark embedder 120, the watermark determiner 125, the crediting facility 135 and the watermark compensator 140 are illustrated as being separate elements in the example media monitoring system 105 of FIG. 1, some or all of the elements can implemented together in a single apparatus, processing system, etc. Furthermore, although the media device and the watermark decoder 130 are illustrated as being separate elements in the example of FIG. 1, the watermark decoder 130 can be implemented by or otherwise included in the media device 115.

Figure 2:
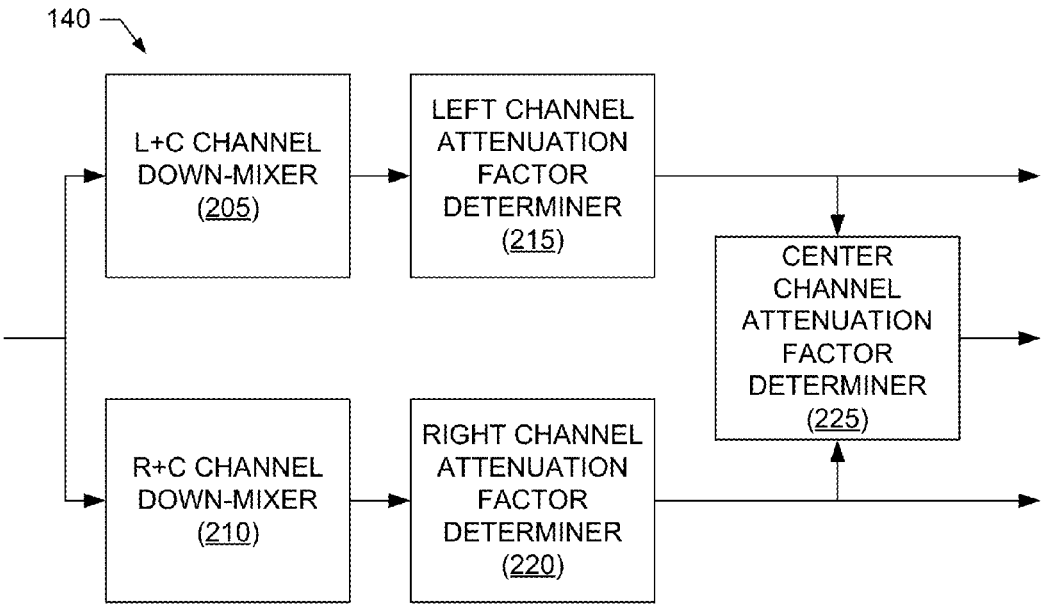
FIG. 2 is a block diagram of a first example watermark compensator that may be used to implement the example media monitoring system of FIG. 1.

A block diagram of a first example implementation of the watermark compensator 140 of FIG. 1 is illustrated in FIG. 2. The example watermark compensator 140 of FIG. 2 implements a down-mixing compensation technique that determines the effects of down-mixing on different critical audio frequency bands in each audio channel of a multichannel audio signal containing a watermark that may be subjected to down-mixing. The watermark compensator 140 further determines respective down-mixing attenuation factors to be applied to the watermark when embedding the watermark code frequencies in the respective different audio bands of the audio channels in the multichannel audio signal.

Turning to FIG. 2, the illustrated example watermark compensator 140 includes example audio channel down-mixers 205, 210 to determine resulting down-mixed audio signals that would be formed by a media device, such as the media device 115, when down-mixing different pairs of first and second audio channels included in multichannel host audio signal. For example, the audio channel down-mixers 205, 210 of the example watermark compensator 140 of FIG. 2 include an example left-plus-center channel audio mixer 205 and an example right-plus-center channel audio mixer 210. In the illustrated example, the left-plus-center channel audio mixer 205 down-mixes audio samples from the left (L) and center (C) channels of a multichannel (e.g., 5.1 or 7.1 channel) audio signal according to Equation 1 (or any other technique) to form a left stereo audio signal ($L_t$), as described above. Similarly, the right-plus-center channel audio mixer 210 down-mixes audio samples from the right (R) and center (C) channels of the multichannel (e.g., 5.1 or 7.1 channel) audio signal according to Equation 2 (or any other technique) to form a right stereo audio signal ($R_t$), as described above.

The example watermark compensator 140 also includes example attenuation factor determiners 215, 220, 225 to determine respective attenuation factors to apply to a watermark when embedding the watermark in some or all of the respective audio channels of the multichannel host audio signal The attenuation factors determined by the attenuation factor determiners 215, 220, 225 are computed using the down-mixed signals generated by the down-mixers 205, 210 to compensate for the actual down-mixing of the multichannel host audio signal that may be performed by a media device, such as the media device 115. In some examples, such as when the audio watermark includes a set of code frequencies embedded in different audio bands of an audio channel, the attenuation factor determiners 215, 220, 225 determine respective sets of attenuation factors for respective audio channels in which the watermark is to be embedded. In such examples each set of attenuation factors for a respective audio channel can include respective attenuation factors for use with the respective different critical audio bands in which the watermark code frequencies can be embedded in the channel.

For example, the attenuation factor determiners 215, 220, 225 of the example watermark compensator 140 of FIG. 2 include an example left channel attenuation factor determiner 215 to determine an attenuation factor, or a set of attenuation factors, to be applied to the watermark for the purposes of providing down-mixing compensation when the watermark is embedded by the watermark embedder 120 in the left channel of the multichannel host audio signal. In some examples, the left channel attenuation factor determiner 215 determines the attenuation factor(s) based on evaluating the energy resulting from down-mixing the left and center audio channels using the left-plus-center channel audio mixer 205. For example, in the case of a watermark having multiple code frequencies as described above, the left channel attenuation factor determiner 215 determines a respective attenuation factor, $k_{d,L}(b)$, for applying to the watermark code frequency to be embedded in audio band b of the left (L) channel of the multichannel signal according to the following equation:

$$k_{d,L}(b) = \frac{K \cdot E_{L+C}(b)}{E_{max(L+C)}(b)} \qquad \text{Equation 5}$$

In Equation 5, the attenuation factor, $k_{d,L}(b)$, for applying to the watermark code frequency to be embedded in audio band b of the left (L) channel is determined as a scaled ratio of the energy ($E_{L+C}(b)$) of the down-mixed left-plus-center channel audio samples in a current audio block of data (e.g., such as the short block described above) in which the watermark code frequency is to be embedded, relative to the maximum energy ($E_{max(L+C)}(b)$) of the down-mixed left-plus-center channel audio samples over multiple audio blocks (e.g., such as the long block described above) including the current audio block. The scale factor (K) is specified or otherwise determined to be a value (e.g., such as 0.7 or some other value) that is expected to adequately attenuate the watermark code frequencies such that the watermark is not perceptible in a resulting down-mixed audio presentation.

The resulting amplitude ($A_L(b)$) of the watermark code signal embedded in audio band b of the left (L) channel is given by the following equation:

$$A_L(b)=\sqrt{k_{d,L}(b)k_{m,L}(b)E_L(b)} \quad \text{Equation 6}$$

As shown in Equation 6, the attenuation factor, $k_{d,L}(b)$ is intended to further attenuate the watermark code frequency embedded in audio band b of the left (L) in addition to the attenuation already provided by the masking ratio $k_{m,L}(b)$ associated with the audio band b of the left (L) channel.

In the illustrated example of FIG. 2, the attenuation factor determiners 215, 220, 225 of the example watermark compensator 140 of FIG. 2 similarly include an example right channel attenuation factor determiner 220 to determine an attenuation factor, or a set of attenuation factors, to be applied to the watermark for the purposes of providing down-mixing compensation when the watermark is embedded by the watermark embedder 120 in the right channel of the multichannel host audio signal. In some examples, the right channel attenuation factor determiner 220 determines the attenuation factor(s) based on evaluating the energy resulting from down-mixing the right and center audio channels using the right-plus-center channel audio mixer 210. For example, in the case of a watermark having multiple code frequencies as described above, the right channel attenuation factor determiner 220 determines a respective attenuation factor, $k_{d,R}(b)$, for applying to the watermark code frequency to be embedded in audio band b of the right (R) channel of the multichannel signal according to the following equation:

$$k_{d,R}(b) = \frac{K \cdot E_{R+C}(b)}{E_{max(R+C)}(b)} \quad \text{Equation 7}$$

In Equation 7, the attenuation factor, $k_{d,R}(b)$, for applying to the watermark code frequency to be embedded in audio band b of the right (R) channel is determined as a scaled ratio of the energy ($E_{R+C}(b)$) of the down-mixed right-plus-center channel audio samples in a current audio block of data (e.g., such as the short block described above) in which the watermark code frequency is to be embedded, relative to the maximum energy ($E_{max(R+C)}(b)$) of the down-mixed right-plus-center channel audio samples over multiple audio blocks (e.g., such as the long block described above) including the current audio block. As described above, the scale factor (K) is specified or otherwise determined to be a value (e.g., such as 0.7 or some other value) that is expected to adequately attenuate the watermark code frequencies such that the watermark is not perceptible in a resulting down-mixed audio presentation.

The resulting amplitude ($A_R(b)$) of the watermark code signal embedded in audio band b of the right (R) channel is given by the following equation:

$$A_R(b)=\sqrt{k_{d,R}(b)k_{m,R}(b)E_R(b)} \quad \text{Equation 8}$$

As shown in Equation 8, the attenuation factor, $k_{d,R}(b)$ is intended to further attenuate the watermark code frequency embedded in audio band b of the left (R) in addition to the attenuation already provided by the masking ratio $k_{m,R}(b)$ associated with the audio band b of the right (R) channel.

The example watermark compensator 140 of FIG. 2 further includes an example center channel attenuation factor determiner 225 to determine an attenuation factor, or a set of attenuation factors, to be applied to the watermark for the purposes of providing down-mixing compensation when the watermark is embedded by the watermark embedder 120 in the center channel of the multichannel host audio signal. In some examples, the center channel attenuation factor determiner 225 determines the attenuation factor(s) to be the minimum(s) of the respective left channel and right channel attenuation factors determined by the left channel attenuation factor determiner 215 and the right channel attenuation factor determiner 220, respectively. For example, in the case of a watermark having multiple code frequencies as described above, the center channel attenuation factor determiner 225 determines a respective attenuation factor, $k_{d,C}(b)$, for applying to the watermark code frequency to be embedded in audio band b of the center (C) channel of the multichannel signal according to the following equation:

$$k_{d,C}(b)=\min\{k_{d,L}(b),k_{d,R}(b)\} \quad \text{Equation 9}$$

In Equation 9, the attenuation factor, $k_{d,C}(b)$, for applying to the watermark code frequency to be embedded in audio band b of the center (C) channel is determined to be the minimum of the attenuation factors $k_{d,L}(b)$ and $k_{d,R}(b)$ that were determined for applying to the watermark code frequency to be embedded in this same audio band b of the left (L) and right ( ) channels, respectively. Also, by comparing Equation 5, Equation 7 and Equation 9, it can be seen that the attenuation factor determiners 215, 220, 225 can determine different (or the same) attenuation factors for the different channels of a multichannel host audio signal, and can further determine different (or the same) attenuation factors for different audio bands of the different channels of the multichannel host audio signal. Furthermore, from these equations, it can be seen that the attenuation factor determiners 215, 220, 225 can update their respective determined attenuation factors for each new (e.g., short) block of audio samples into which a watermark is to be embedded.

Figure 3:
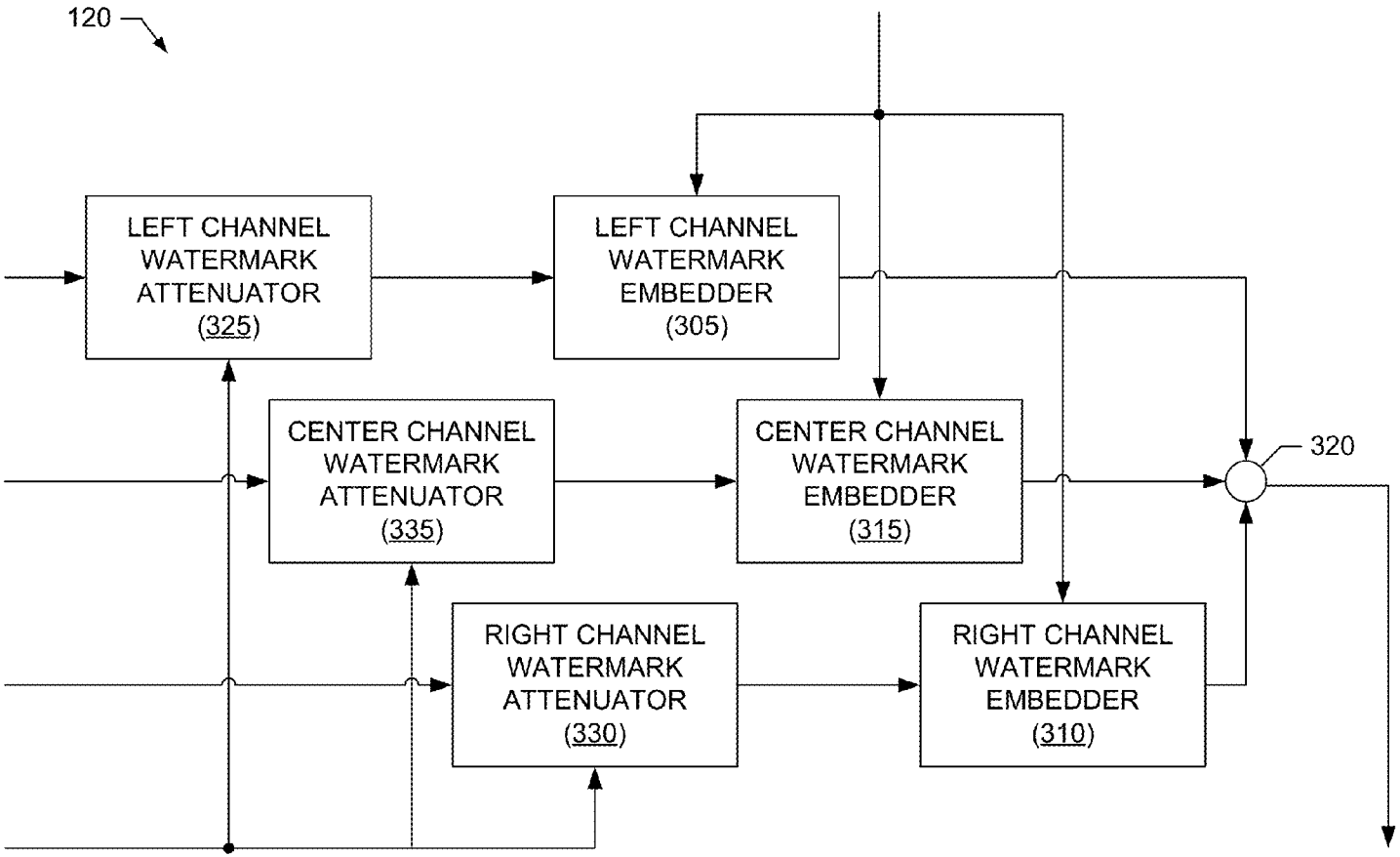
FIG. 3 is a block diagram of a first example watermark embedder that may be used with the example watermark compensator of FIG. 2 to implement the example media monitoring system of FIG. 1.

A block diagram of a first example implementation of the watermark embedder 120 of FIG. 1 is illustrated in FIG. 3. The example watermark embedder 120 of FIG. 3 is configured to apply the attenuation factors determined by the example watermark compensator 140 of FIG. 2 to a watermark that is to be embedded in the different audio channels of a multichannel host audio signal. In the illustrated example of FIG. 3, for a given segment of the multichannel host audio signal, the watermark embedder 120 embeds the same watermark in at least some of the different audio channels of the multichannel host audio signal. For example, the example watermark embedder 120 of FIG. 3 includes an example left channel watermark embedder 305, an example right channel watermark embedder 310 and an example center channel watermark embedder 315 to embed the same watermark in audio blocks (e.g., short blocks) from the left, right and center channels, respectively, of the multichannel host audio signal. The watermark embedders 305, 310, 315 can implement any number, type(s) or combination of audio watermarking techniques to embed audio watermark in the respective channels of the multichannel host audio signal. For example, the watermark embedders 305, 310, 315 can implement the example audio watermarking technique of U.S. Patent Publication No. 2010/0106510, which is discussed in detail above, to embed a watermark including multiple code frequencies in each of the left, right and center audio channels of the multichannel host audio signal. The resulting watermarked audio channels are then combined into, for example, a 5.1 or 7.1 multichannel format, or any other format, using an example audio channel combiner 320.

To support down-mixing compensation for audio watermarking, the example watermark embedder 120 of FIG. 3 also includes example watermark attenuators 325, 330, 335 to receive the attenuation factors determined by the example watermark compensator 140 of FIG. 2 and to apply these attenuation factors when to the watermark during the embedding process. For example, the example watermark embedder 120 of FIG. 3 includes an example left channel watermark attenuator 325 to apply the attenuation factors $k_{d,L}(b)$, which were determined for the different audio bands of the left channel, to the watermark to be embedded by the left channel watermark embedder 305 in a current block of left channel audio. The example watermark embedder 120 of FIG. 3 also includes an example right channel watermark attenuator 330 to apply the attenuation factors $k_{d,R}(b)$, which were determined for the different audio bands of the right channel, to the watermark to be embedded by the right channel watermark embedder 310 in a current block of right channel audio. The example watermark embedder 120 of FIG. 3 further includes an example center channel watermark attenuator 335 to apply the attenuation factors $k_{d,C}(b)$, which were determined for the different audio bands of the center channel, to the watermark to be embedded by the center channel watermark embedder 315 in a current block of center channel audio. Accordingly, the watermark embedder 120 of the illustrated example of FIG. 3 can apply different (or the same) attenuation factors, for the purposes of providing down-mixing compensation, to perform different (or the same) watermark scaling in different channels of a multichannel host audio signal, and can further apply different (or the same) attenuation factors to perform different (or the same) watermark scaling in different audio bands of the different channels of the multichannel host audio signal.

Referring back to the example implementation of the watermark compensator 140 illustrated in FIG. 2, in some examples it may not be feasible for the watermark compensator 140 to determine all of the possible combinations of down-mixed signals. For example, in scenarios in which the audio watermark processing for different audio channels is performed in different audio signal processor, it may not practical to route the audio samples for different channels among the different processors. Thus, in such examples, it may not be possible for the watermark compensator 140 to determine different attenuation factors for the different respective audio channels in which a watermark is to be embedded. However, it may be feasible to determine the down-mixed signal for one possible combination of down-mixed signals, and to use this down-mixed signal as a proxy for estimating the effect of down-mixing on all of the audio channels containing a watermark that may be subjected to down-mixing. In such examples, the watermark compensator 140 could determine one attenuation factor (or one set of attenuation factors) based on this down-mixed audio signal, and then use this same attenuation factor (or this same set of attenuation factors) for some or all of the audio channels of interest.

Figure 4:
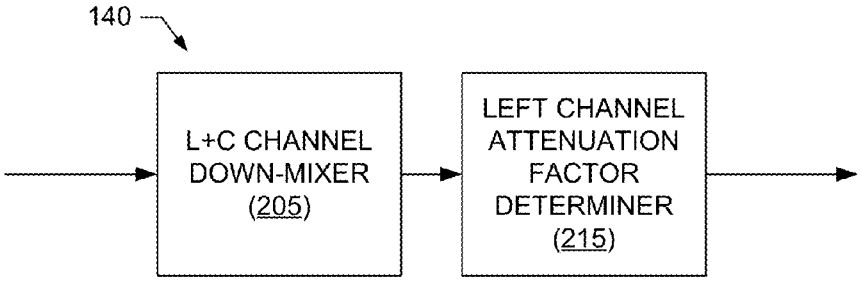
FIG. 4 is a block diagram of a second example watermark compensator that may be used to implement the example media monitoring system of FIG. 1.

With the foregoing in mind, a block diagram of a second example implementation of the watermark compensator 140 of FIG. 1 is illustrated in FIG. 4. The example watermark compensator 140 of FIG. 3 includes one of the example audio channel down-mixers 205, 210 from the example watermark compensator 140 of FIG. 2 to determine a resulting down-mixed audio signal formed when down-mixing a first and second audio channel included in multichannel host audio signal. The example watermark compensator 140 of FIG. 4 also includes one of the example attenuation factor determiners 215, 220 to determine, using the generated down-mixed signal, a same attenuation factor (or a same set of attenuation factors) to use when embedding a watermark in some or all of the audio channels of the multichannel host audio signal. Thus, unlike the example watermark compensator 140 of FIG. 2, which can determine different combinations of down-mixed signals and, thus, different attenuation factors for the audio channels of the multichannel host audio signal, the example watermark compensator 140 of FIG. 4 determines one down-mixed signal from one combination of audio channels and, thus, determines one attenuation factor (or one set of attenuation factors for applying over the audio bands), per audio (e.g., short) block of the multichannel audio signal, for use over some or all of the audio channels in which the watermark is to be embedded.

For example, the watermark compensator 140 of FIG. 4 includes the left-plus-center channel audio mixer 205 to down-mix audio samples from the left (L) and center (C) channels of a multichannel (e.g., 5.1 or 7.1 channel) audio signal according to Equation 1 (or any other technique) to form a left stereo audio signal ($L_t$), as described above. This down-mixed left stereo audio signal ($L_t$) is then used as a proxy to also represent the down-mixed right stereo audio signal ($R_t$). In other words, the effects of down-mixing are assumed to be substantially the same in both the left and right audio channels. The watermark compensator 140 of FIG. 4 also includes the example left channel attenuation factor determiner 215 to determine an attenuation factor, or a set of attenuation factors, based on evaluating the energy resulting from down-mixing the left and center audio channels using the left-plus-center channel audio mixer 205, as described above. The determined attenuation factor, or set of attenuation factor, would then be used to attenuate the watermark when embedding the watermark in, for example, each of the left, right and center channels of the multichannel host audio signal. Alternatively, in other examples, the watermark compensator 140 of FIG. 4 could include the right-plus-center channel audio mixer 210 and the right channel attenuation factor determiner 220 to determine the attenuation factor, or the set of attenuation factors, by examining the effects of down-mixing between the right and center audio channels, as described above in connection with FIG. 2.

Figure 5:
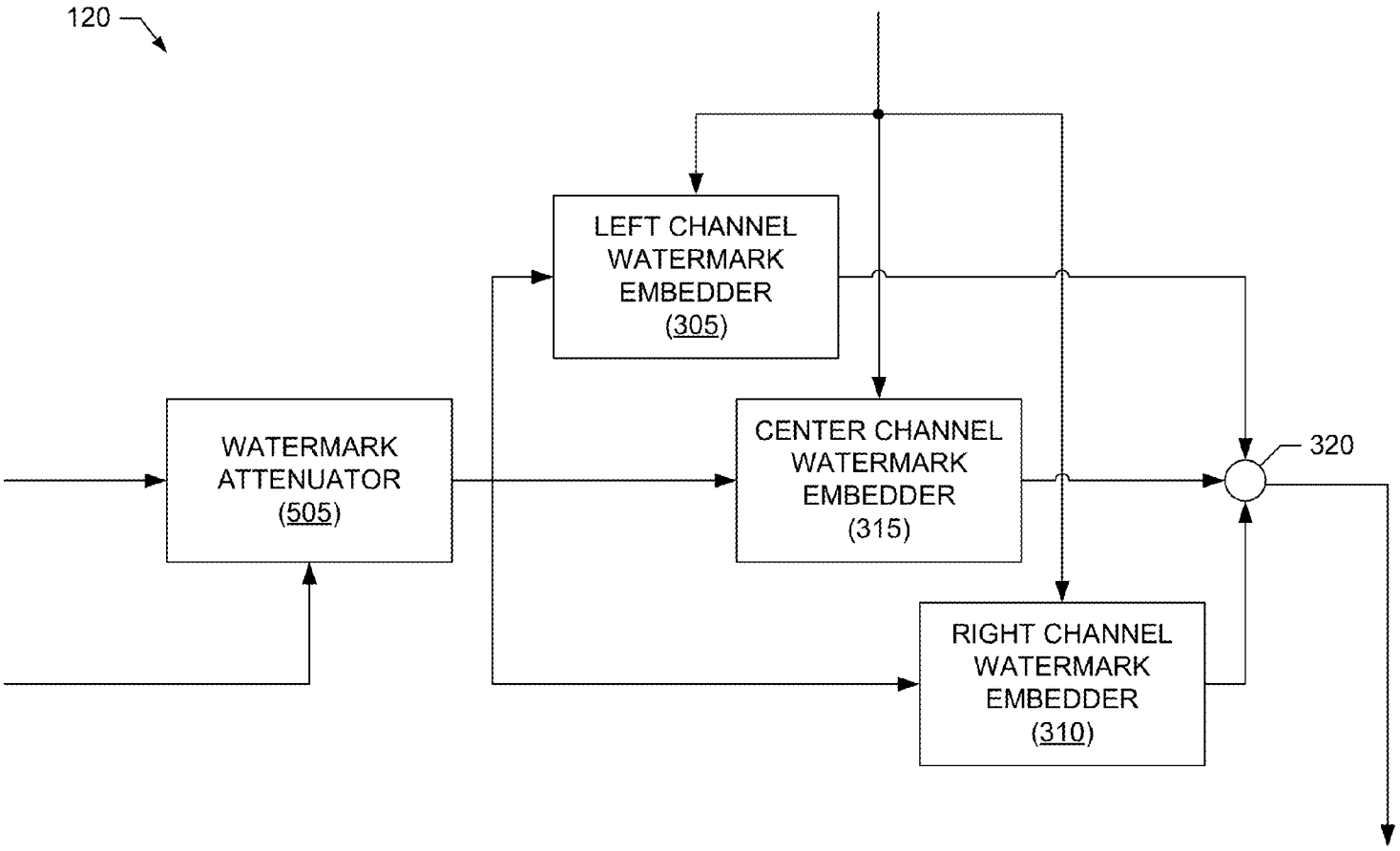
FIG. 5 is a block diagram of a second example watermark embedder that may be used with the example watermark compensator of FIG. 4 to implement the example media monitoring system of FIG. 1.
Figure 6:
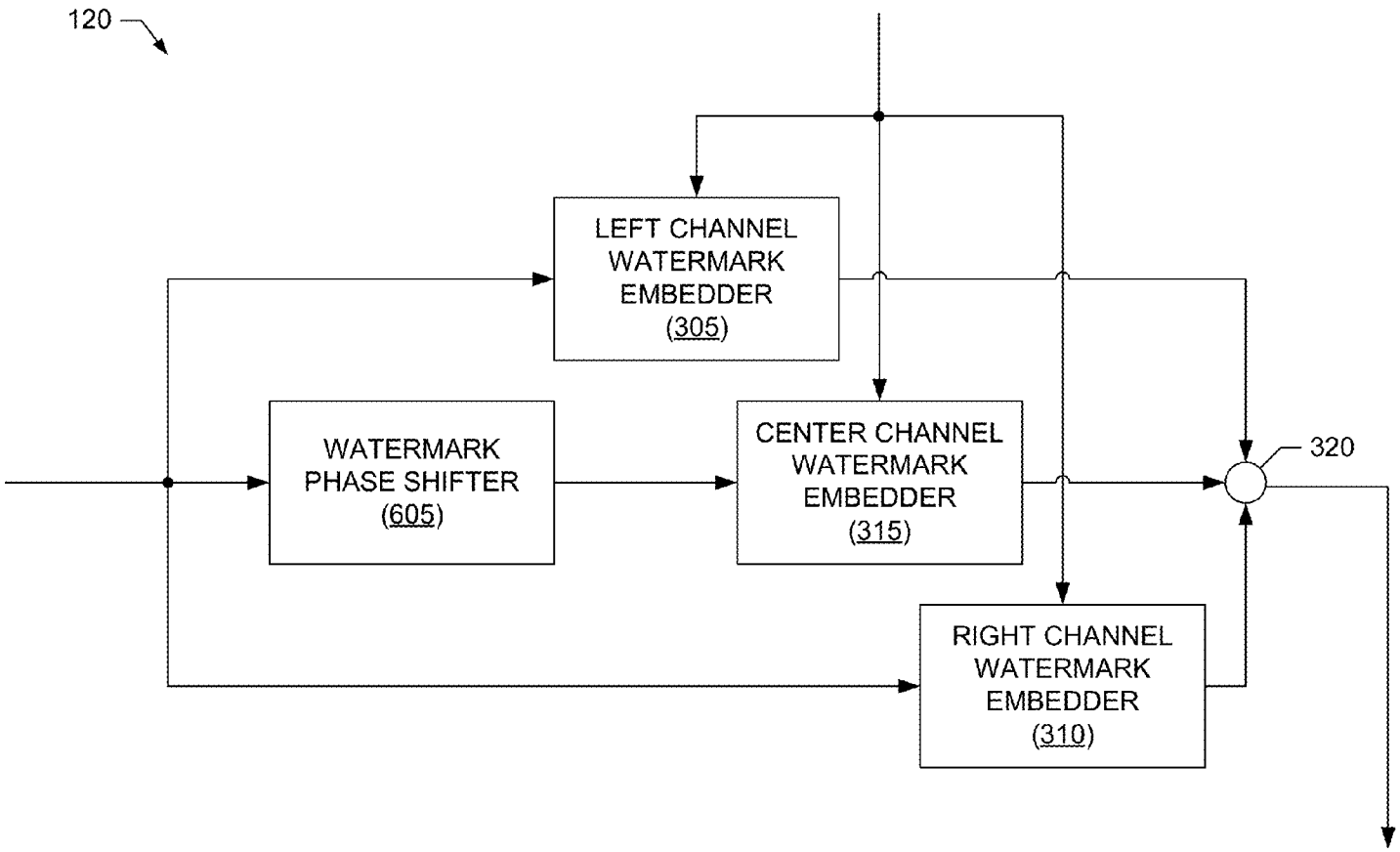
FIG. 6 is a block diagram of a third example watermark embedder that may be used to implement down-mixing compensation for audio watermarking in the example media monitoring system of FIG. 1.

A block diagram of a second example implementation of the watermark embedder 120 of FIG. 1 is illustrated in FIG. 5. The example watermark embedder 120 of FIG. 6 is configured to apply, for a given audio (e.g., short) block of a multichannel host audio signal, the same attenuation factor (or same set of attenuation factors for applying over a group of audio bands) determined by the example watermark compensator 140 of FIG. 4 to a watermark that is to be embedded in the different audio channels of the multichannel host audio signal. The second example watermark embedder 120 of FIG. 5 includes many elements in common with the first example watermark embedder 120 of FIG. 3. As such, like elements in FIGS. 3 and 5 are labeled with the same reference numerals. For example, the watermark embedder 120 of FIG. 5 includes the example left channel watermark embedder 305, the example right channel watermark embedder 310, the example center channel watermark embedder 315 and the example audio channel combiner 320 of FIG. 3. The detailed descriptions of these like elements are provided above in connection with the discussion of FIG. 3 and, in the interest of brevity, are not repeated in the discussion of FIG. 5.

However, unlike the example watermark embedder 120 of FIG. 3, which includes different watermark attenuators 325, 330, 335 to apply different watermark attenuation factors to the different audio channels, the example watermark embedder 120 of FIG. 5 includes an example watermark attenuator 505 to apply the same attenuation factor (or same set of factors) received from the example watermark compensator 140 of FIG. 4 to some or all of the audio channels in which a watermark is to be embedded. For example, the watermark attenuator 505 of the illustrated example can apply the same set of attenuation factors $k_{d,L}(b)$, which were determined for the different audio bands of the left channel by the left channel attenuation factor determiner 215, to the watermark when embedding this watermark in current blocks of the left channel audio, the center channel audio and the right channel audio of the multichannel audio signal.

A block diagram of a third example implementation of the watermark embedder 120 of FIG. 1 is illustrated in FIG. 6. The example watermark embedder 120 of FIG. 6 is configured to provide down-mixing compensation for audio watermarking by applying a phase shift to a watermark when embedding the watermark in some, but not all of, the audio channels of a multichannel host audio signal. For example, when the same watermark is to be embedded in some or all of the audio channels of the multichannel host audio signal, the watermark embedder 120 of FIG. 6 can apply a phase shift to one, or a subset, of the audio channels such that, during down-mixing, the watermark with the phase shift will destructively combine with the watermark(s) that were embedded in the other audio channels without a phase shift. The down-mixing of the same watermark, but with different phases relative to each other, can reduce the amplitude of the down-mixed watermark, thereby helping to keep this down-mixed watermark masked in the down-mixed audio signal. The example implementation of the watermark embedder 120 illustrated in FIG. 6 can be useful when, for example, it is not feasible for the watermark compensator 140 to perform down-mixing of the different audio channels of the multichannel host audio signal (e.g., such as when the audio watermark processing for different audio channels is performed in different audio signal processors and it is not practical to route the audio samples for different channels between these processors).

Turning to FIG. 6, the third example watermark embedder 120 illustrated therein includes many elements in common with the first and second example watermark embedders 120 of FIGS. 3 and 5, respectively. As such, like elements in FIGS. 3, 5 and 6 are labeled with the same reference numerals. For example, the watermark embedder 120 of FIG. 6 includes the example left channel watermark embedder 305, the example right channel watermark embedder 310, the example center channel watermark embedder 315 and the example audio channel combiner 320 of FIGS. 3 and 5. The detailed descriptions of these like elements are provided above in connection with the discussion of FIG. 3 and, in the interest of brevity, are not repeated in the discussion of FIG. 6.

However, unlike the example watermark embedders 120 of FIGS. 3 and 5, which apply one or more attenuation factors to a watermark to be embedded in a multichannel host audio signal, the example watermark embedder 130 of FIG. 6 includes an example watermark phase shifter 605 to apply a phase shift to a watermark prior to the watermark being embedded in one (or a subset of) the audio channels. For example, when the watermark includes a set of code frequencies (such as in the example audio watermarking techniques described above), the watermark phase shifter 605 applies a phase shift of 90 degrees (or some other value) to the watermark code frequencies to be embedded in one of the audio channels, such as the center channel of the multichannel host audio signal. In such examples, the watermark code frequencies are embedded in the other audio channels without a phase shift. Applying a phase shift of 90 degrees to the watermark embedded in the center audio channel results in a watermark amplitude attenuation of 0.707 (or an energy attenuation of 0.5) when the center audio channel is down-mixed by a media device (e.g., the media device 115) with another of the audio channels (e.g., the left front channel or the right front channel). This watermark attenuation can help keep the down-mixed watermark masked in the down-mixed audio signal. However, because the watermark phase shifter 605 applies a phase shift to the watermark and not an attenuation factor, the watermark that is phase-shifted can still be embedded in its respective audio channel (e.g., the center channel) at its original level. Thus, detection of the phase-shifted watermark in a non-mixed audio signal (e.g., such as by a microphone positioned to detect the center channel audio output by the media device 115) does not suffer the potential performance degradation that could occur when, as in the preceding examples, an attenuation factor is used to provide down-mixing compensation for audio watermarking.

In some examples, the watermark phase shifter 605 can be configured to apply different phase shifts to the watermarks applied to different ones of the multichannel host audio signal. This can be helpful to support different combination of audio channel down-mixing that can be supported by different media devices, or by the same media device. Also, in some examples, the watermark phase shifter 605 receives a control input from, for example, the watermark compensator 140 to control whether phase shifting is enabled or disabled (e.g., for all audio channels, or for a selected subset of one or more channels, etc.).

In some example operating scenarios, down-mixing can cause an embedded watermark to become perceptible because there is a delay between the audio channels being down-mixed. For example, in a live broadcast with audio at different locations being obtained from different microphones or other audio pickup devices, there may be a delay between the audio in the center and left channels, a delay between the center and right channels, etc. Such delays can be further caused by broadcast signal processing hardware and, thus, can be difficult to track and remove prior to providing the multichannel audio signal to a media device, such as the media device 115. In the case when broadcast quality audio is sampled at 48 kHz, a six (6) sample delay between center and left audio channels corresponds to a phase shift of 180 degree at an audio frequency of 4 kHz. Upon down-mixing these two audio channels to form the left stereo channel, the resulting audio will have very little spectral energy in the neighborhood of 4 kHz due the 180 degree phase shift between the channels at this frequency. As a result, watermark signals (e.g., code frequencies) present in this frequency neighborhood (e.g., around 4 kHz in this example) will be rendered audible. Other sample delays can cause similar spectral energy loss in other frequency neighborhoods.

Figure 7:
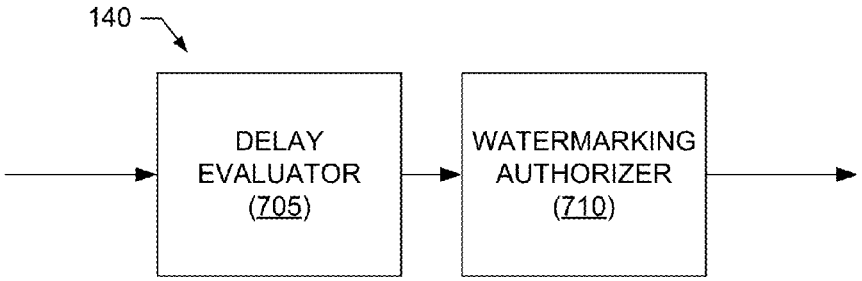
FIG. 7 is a block diagram of a third example watermark compensator that may be used to implement down-mixing compensation for audio watermarking in the example media monitoring system of FIG. 1.

With this in mind, a block diagram of a third example implementation of the watermark compensator 140 of FIG. 1 is illustrated in FIG. 7. The third example watermark compensator 140 of FIG. 7 detects whether delays are present between audio channels that can undergo down-mixing at a receiving media device (e.g., the media device 115) and controls the audio watermarking of these audio channels accordingly. In the illustrated example of FIG. 7, the watermark compensator 140 includes an example delay evaluator 705 to evaluate a delay between a pair of audio channels, such as between the left and center audio channel of a multichannel host audio signal, which may be subject to down-mixing by a receiving media device, such as the media device 115. In some examples, the delay evaluator 705 determines the delays between multiple pairs of audio channels, such as a first delay between the left and center audio channel and a second delay between the right and center audio channel, which may be subject to down-mixing by the media device 115.

The example watermark compensator 140 of FIG. 7 also includes an example watermarking authorizer 710 to process the audio channel delay(s) determined by the delay evaluator 705 to determine whether to authorize audio watermarking of the multichannel host audio signal. For example, the watermarking authorizer 710 can set a decision indicator to indicate that watermarking of a current block of audio from the multichannel host audio signal is not permitted (and, thus, watermarking is to be disabled) when the watermarking authorizer 710 determines that the current audio channel delay evaluated by the delay evaluator 705 is in a range of delays that can cause the watermark to become audible after down-mixing. Conversely, the watermarking authorizer 710 can set the decision indicator to indicate that watermarking of the current block of audio from the multichannel host audio signal is permitted (and, thus, watermarking is to be enabled) when the watermarking authorizer 710 determines that the current audio channel delay evaluated by the delay evaluator 705 is outside the range of delays that can cause the watermark to become audible after down-mixing. In some examples, the watermarking authorizer 710 outputs its decision indicator to the watermark embedder 120 to control whether audio watermarking is to be enabled or disabled for a current audio block (e.g., short block or long block) of the multichannel host audio signal.

In some examples, the delay evaluator 705 determines the delay between two audio channels by performing a normalized correlation between audio samples from the two channels. For example, to determine the delay between the left and center audio channels of a multichannel host audio signal, the delay evaluator 705 may be configured to have access to audio buffers storing audio samples from the left and center audio channels into which a watermark is to be embedded. In the example watermarking technique described above, which involves long block and short block audio processing, each audio buffer may store, for example, 256 audio samples. Assuming the delay evaluator 705 has access to ten (10) such audio buffers for each of the left and center audio channels, and the buffers are time-aligned, then the left and center channel audio samples available to the delay evaluator 705 can be represented as two vectors, $P_L[k]$ of the left channel and $P_C[k]$ for the center channel, given by the following equations:

$$P_L[k]k=0,1,\ldots 2559 \quad \text{Equation 10}$$

and $$P_C[k]k=0,1,\ldots 2559 \quad \text{Equation 11}$$

In some examples, it may be advantageous for the delay evaluator 705 to use down-sampled versions of the left and center channel audio vectors, $P_L[k]$ and $P_C[k]$, represented by Equation 10 and Equation 11. For example, down-sampling may make it possible to transmit smaller blocks of audio samples between audio signal processors processing the different audio channels, which may be beneficial when inter-processor communication bandwidth is limited. For example, if the delay evaluator 705 is configured to use every eight audio samples of the left and center channel audio vectors, $P_L[k]$ and $P_C[k]$, then the resulting down-sampled audio vectors, $P_{L,d}[k]$ of the left channel and $P_{C,d}[k]$ for the center channel, are given by the following equations:

$$P_{L,d}[k]=P_L[256+k*8]k=0,1,2,\ldots 255 \quad \text{Equation 12}$$

and $$P_{C,d}[k]=P_C[256+k*8]k=0,1,2,\ldots 255 \quad \text{Equation 13}$$

In such examples, the delay evaluator 705 can determine the delay between the audio samples of the left and center audio channels by computing a normalized correlation between the down-sampled audio vectors, $P_{L,d}[k]$ and $P_{C,d}[k]$, for the left and center channels. For example, the delay evaluator 705 can determine such a normalized correlation by: (1) normalizing the samples in each down-sampled audio vector by the sum of squares of the audio samples in the vector, and (2) computing a dot product between the normalized, down-sampled audio vectors for different delays (e.g., shifts) between the vectors. Stated mathematically, assuming that the down-sampled audio vectors, $P_{L,d}[k]$ and $P_{C,d}[k]$, for the left and center channels have been normalized, then the dot product between these vectors at a delay d is given by the following equation:

$$P_{dot}(d) = \sum_k P_{L,d}[k] \cdot P_{C,d}[k+d] \quad \text{Equation 13}$$

If there is little to no delay between the left and center audio channels, and there is at least partial correlation between the audio samples in the channels, then the maximum correlation value (e.g., dot product value) is expected to occur at a delay of d=0. If there is a delay between the left and center audio channels, then this delay is expected to correspond to the maximum correlation value (e.g., dot product value) if there is adequate correlation between the channels to detect this delay. Accordingly, in some examples, if the maximum correlation value (e.g., dot product value) between the left and center audio channels as determined by Equation 13 occurs at a delay $d_t$ other than 0, then the delay evaluator 705 accepts and outputs this delay provided that the correlation value (e.g., dot product value) for this delay value exceeds (or meets) a threshold (e.g., such as a threshold of 0.45 or some other value). In other words, the delay evaluator 705 accepts and outputs a determined delay of $d_t$, which is non-zero, if $P_{dot}(d_t)>T$, where T is the threshold (e.g., T=0.45). Otherwise, the delay evaluator 705 indicates that the delay between the audio channels is d=0.

In some examples, the delay evaluator 705 uses Equation 13 to determine the correlation values (e.g., dot product values) over a range of delays, such as over delays ranging from d=−12 through d=11, and outputs the delay $d_t$ corresponding to the maximum correlation value (e.g., dot product value). The watermarking authorizer 710 in such examples examines the delay $d_t$ output by delay evaluator 705 to determine whether the delay $d_t$ relies in a range of delays (e.g., such in the range from 5 to 8 samples) which may cause watermark code frequencies (e.g., in the range of 3 to 5 kHz) to become audible upon down-mixing. If the delay $d_t$ output by delay evaluator 705 lies in this range of delays (e.g., in a range of 5 to 8 samples), the watermarking authorizer 710 indicates that audio watermarking is not to be performed for the current audio block of the multichannel audio signal. However, if the delay $d_t$ output by delay evaluator 705 lies outside this range of delays (e.g., outside a range of 5 to 8 samples), the watermarking authorizer 710 indicates that audio watermarking can be performed for the current audio block of the multichannel audio signal.

In some examples, one or more of the example implementations for the watermark compensator 140 and/or the watermark embedder 120 described above can be combined to provide further down-mixing compensation for audio watermarking. For example, the delay evaluation processing performed by the example watermark compensator 140 of FIG. 7 can be used to determine whether audio watermarking is authorized for a current audio block (e.g., short block or long block). If audio watermarking is authorized, then the processing performed by the example watermark compensator 140 of FIGS. 2 and/or 4, and the processing performed by the corresponding example watermark embedder of FIGS. 3 and/or 5 can be used to attenuate the watermark to be embedded in one or more of the audio channels of the multichannel host audio signal. Additionally or alternatively, if audio watermarking is authorized based on the audio delay evaluation, then the processing performed by the example watermark embedder of FIG. 6 can be used to introduce a phase shift into the watermark to be embedded in one or a subset of the audio channels of the multichannel host audio signal.

While example manners of implementing the example environment of use 100 are illustrated in FIGS. 1-7, one or more of the elements, processes and/or devices illustrated in FIGS. 1-7 may be combined, divided, re-arranged, omitted, eliminated and/or implemented in any other way. Further, the example media monitoring system 105, the example media device 115, the example watermark embedder 120, the example watermark determiner 125, the example watermark decoder 130, the example crediting facility 135, the example watermark compensator 140, the example audio channel down-mixers 205 and/or 210, the example attenuation factor determiners 215, 220 and/or 225, the example watermark embedders 305, 310, 315 and/or 505, the example audio channel combiner 320, the example watermark attenuators 325, 330 and/or 335, the example watermark phase shifter 605, the example delay evaluator 705, the example watermarking authorizer 710 and/or, more generally, the example environment of use 100 may be implemented by hardware, software, firmware and/or any combination of hardware, software and/or firmware. Thus, for example, any of the example media monitoring system 105, the example media device 115, the example watermark embedder 120, the example watermark determiner 125, the example watermark decoder 130, the example crediting facility 135, the example watermark compensator 140, the example audio channel down-mixers 205 and/or 210, the example attenuation factor determiners 215, 220 and/or 225, the example watermark embedders 305, 310, 315 and/or 505, the example audio channel combiner 320, the example watermark attenuators 325, 330 and/or 335, the example watermark phase shifter 605, the example delay evaluator 705, the example watermarking authorizer 710 and/or, more generally, the example environment of use 100 could be implemented by one or more analog or digital circuit(s), logic circuits, programmable processor(s), application specific integrated circuit(s) (ASIC(s)), programmable logic device(s) (PLD(s)) and/or field programmable logic device (s) (FPLD(s)). When reading any of the apparatus or system claims of this patent to cover a purely software and/or firmware implementation, at least one of the example environment of use 100, the example media monitoring system 105, the example media device 115, the example watermark embedder 120, the example watermark determiner 125, the example watermark decoder 130, the example crediting facility 135, the example watermark compensator 140, the example audio channel down-mixers 205 and/or 210, the example attenuation factor determiners 215, 220 and/or 225, the example watermark embedders 305, 310, 315 and/or 505, the example audio channel combiner 320, the example watermark attenuators 325, 330 and/or 335, the example watermark phase shifter 605, the example delay evaluator 705 and/or the example watermarking authorizer 710 is/are hereby expressly defined to include a tangible computer readable storage device or storage disk such as a memory, a digital versatile disk (DVD), a compact disk (CD), a Blu-ray disk, etc. storing the software and/or firmware. Further still, the example environment of use 100 of FIG. 1 may include one or more elements, processes and/or devices in addition to, or instead of, those illustrated in FIGS. 1-7, and/or may include more than one of any or all of the illustrated elements, processes and devices.

Flowcharts representative of example machine readable instructions for implementing the example environment of use 100, the example media monitoring system 105, the example media device 115, the example watermark embedder 120, the example watermark determiner 125, the example watermark decoder 130, the example crediting facility 135, the example watermark compensator 140, the example audio channel down-mixers 205 and/or 210, the example attenuation factor determiners 215, 220 and/or 225, the example watermark embedders 305, 310, 315 and/or 505, the example audio channel combiner 320, the example watermark attenuators 325, 330 and/or 335, the example watermark phase shifter 605, the example delay evaluator 705 and/or the example watermarking authorizer 710 of FIGS. 1-7 are shown in FIGS. 8-12. In these examples, the machine readable instructions comprise one or more programs for execution by a processor such as the processor 1312 shown in the example processor platform 1300 discussed below in connection with FIG. 13. The program(s) may be embodied in software stored on a tangible computer readable storage medium such as a CD-ROM, a floppy disk, a hard drive, a digital versatile disk (DVD), a Blu-ray disk, or a memory associated with the processor 1312, but the entire program(s) and/or parts thereof could alternatively be executed by a device other than the processor 1312 and/or embodied in firmware or dedicated hardware. Further, although the example program(s) is(are) described with reference to the flowcharts illustrated in FIGS. 8-12, many other methods of implementing the example environment of use 100, the example media monitoring system 105, the example media device 115, the example watermark embedder 120, the example watermark determiner 125, the example watermark decoder 130, the example crediting facility 135, the example watermark compensator 140, the example audio channel down-mixers 205 and/or 210, the example attenuation factor determiners 215, 220 and/or 225, the example watermark embedders 305, 310, 315 and/or 505, the example audio channel combiner 320, the example watermark attenuators 325, 330 and/or 335, the example watermark phase shifter 605, the example delay evaluator 705 and/or the example watermarking authorizer 710 may alternatively be used. For example, the order of execution of the blocks may be changed, and/or some of the blocks described may be changed, eliminated, or combined.

As mentioned above, the example processes of FIGS. 8-12 may be implemented using coded instructions (e.g., computer and/or machine readable instructions) stored on a tangible computer readable storage medium such as a hard disk drive, a flash memory, a read-only memory (ROM), a compact disk (CD), a digital versatile disk (DVD), a cache, a random-access memory (RAM) and/or any other storage device or storage disk in which information is stored for any duration (e.g., for extended time periods, permanently, for brief instances, for temporarily buffering, and/or for caching of the information). As used herein, the term tangible computer readable storage medium is expressly defined to include any type of computer readable storage device and/or storage disk and to exclude propagating signals. As used herein, "tangible computer readable storage medium" and "tangible machine readable storage medium" are used interchangeably. Additionally or alternatively, the example processes of FIGS. 8-12 may be implemented using coded instructions (e.g., computer and/or machine readable instructions) stored on a non-transitory computer and/or machine readable medium such as a hard disk drive, a flash memory, a read-only memory, a compact disk, a digital versatile disk, a cache, a random-access memory and/or any other storage device or storage disk in which information is stored for any duration (e.g., for extended time periods, permanently, for brief instances, for temporarily buffering, and/or for caching of the information). As used herein, the term non-transitory computer readable medium is expressly defined to include any type of computer readable device or disk and to exclude propagating signals. As used herein, when the phrase "at least" is used as the transition term in a preamble of a claim, it is open-ended in the same manner as the term "comprising" is open ended.

Figure 8:
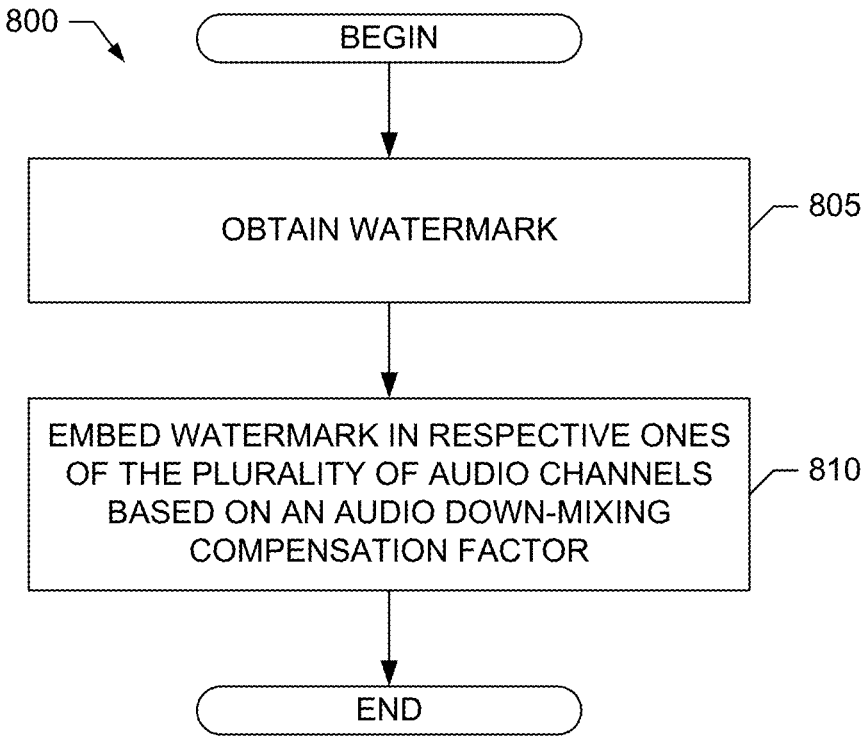
FIG. 8 is a flowchart representative of example machine readable instructions that may be executed to implement down-mixing compensation for audio watermarking in the example media monitoring system of FIG. 1.

Example machine readable instructions 800 that may be executed to perform down-mixing compensation for audio watermarking in the example media monitoring system 105 of FIG. 1 are illustrated in FIG. 8. In the context of the example watermarking technique described above in which watermarks are embedded in short blocks of audio data, the machine readable instructions 800 of the illustrated example can be performed on each short block of audio data to be watermarked. With reference to the preceding figures and associated descriptions, the example machine readable instructions 800 of FIG. 8 begin execution at block 805 at which the example watermark embedder 120 obtains a watermark from the example watermark determiner 125 for embedding in multiple channels of a multichannel host audio signal, as described above. At block 810, the watermark embedder 120 embeds the watermark in the multiple audio channels of the multichannel host audio signal based on a compensation factor that is to reduce perceptibility of the watermark if and when a first one of the audio channels is later down-mixed with a second one of the audio channels after the watermark has been applied to the first and second ones of the audio channels. As described above, the compensation factor on which the watermark embedding at block 810 is based can correspond to, for example, (1) one or more watermark attenuation factors determined by the example watermark compensator 140 for applying to a watermark that is to be embedded in the different audio channels, (2) a decision factor to enable or disable watermarking based on a delay between audio channels as observed by the watermark compensator 140, (3) a phase shift applied to a watermark when embedding the watermark in one or subset of the audio channels in the multichannel host audio signal, etc., or any combination thereof.

Figure 9A:
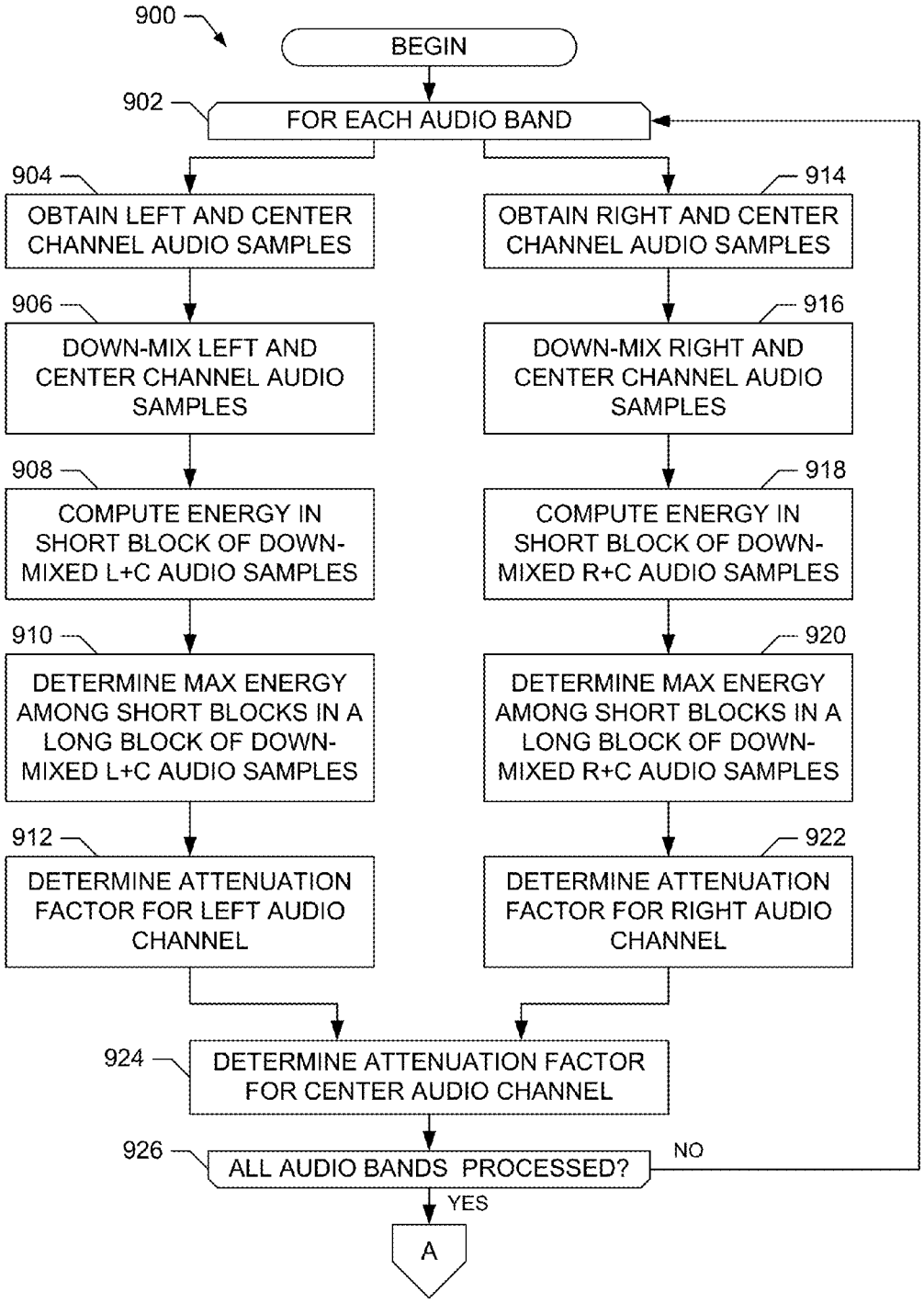
FIGS. 9A-9B collectively form a flowchart representative of example machine readable instructions that may be executed to implement the first example watermark compensator of FIG. 2 and the first example watermark embedder of FIG. 3.
Figure 9B:
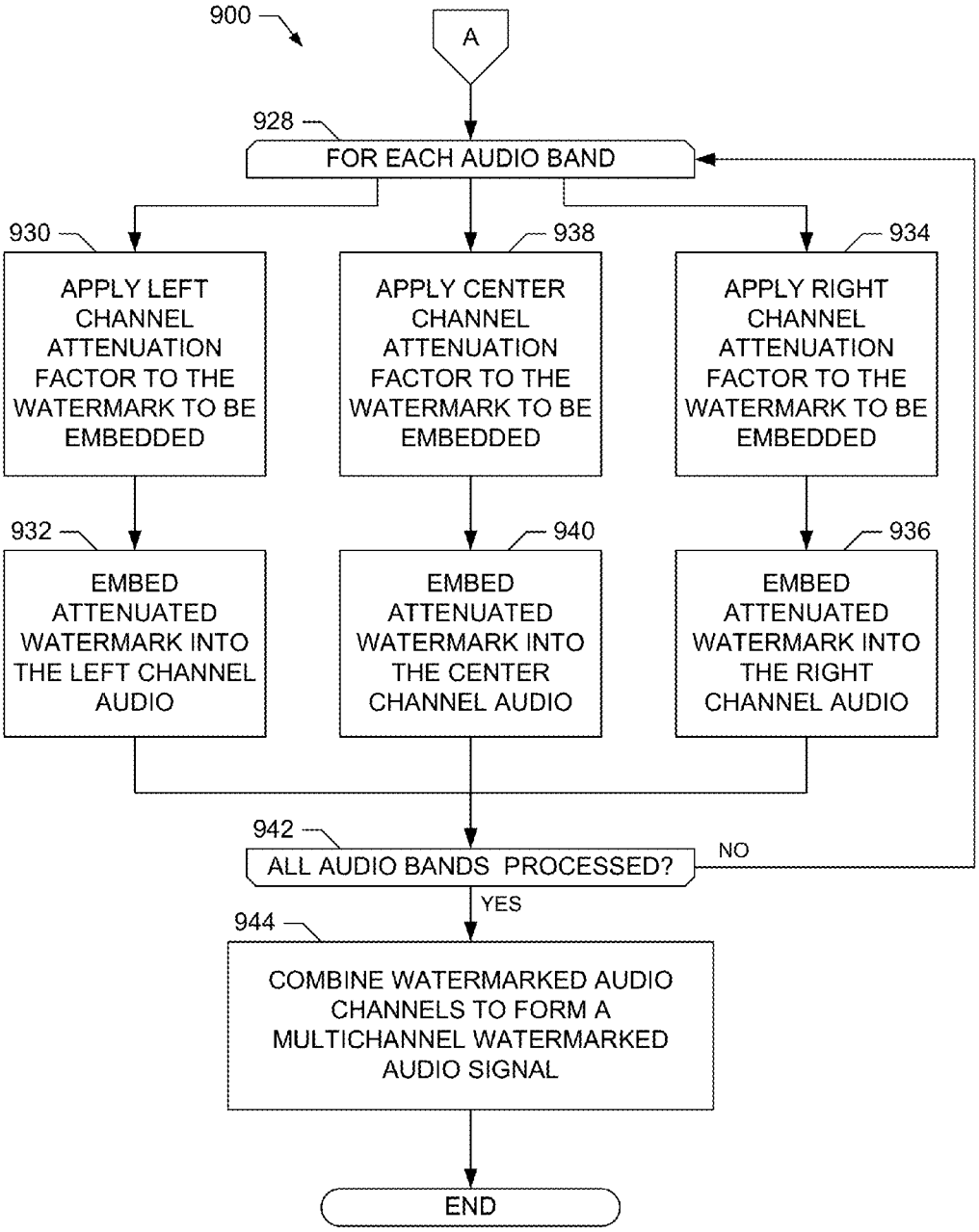

Example machine readable instructions 900 that may be executed by the watermark compensator 140 of FIG. 2 and the example watermark embedder 120 of FIG. 3 to perform down-mixing compensation for audio watermarking in the example media monitoring system 105 of FIG. 1 are illustrated in FIGS. 9A-B. The example machine readable instructions 900 correspond to an example implementation by the watermark compensator 140 of FIG. 2 and the watermark embedder 120 of FIG. 3 of the functionality provided by the example machine readable instructions 800 of FIG. 8. With reference to the preceding figures and associated descriptions, the example machine readable instructions 900 of FIGS. 9A-B begin execution at block 902 of FIG. 9A at which the watermark compensator 140 iterates through each audio band in which a code frequency of a watermark is to be embedded, as described above. For each audio band, at block 904 the left-plus-center channel audio mixer 205 of the watermark compensator 140 obtains audio samples from the left (L) and center (C) channels of a multichannel host audio signal. At block 906, the left-plus-center channel audio mixer 205 down-mixes the audio samples obtained at block 904 to form a left stereo audio signal ($L_t$), as described above. At block 908, the left channel attenuation factor determiner 215 of the watermark compensator 140 computes the energy in the current short block of mixed left and center audio samples (e.g., the left stereo audio samples) determined at block 906. At block 910, the left channel attenuation factor determiner 215 determines a maximum energy among the group of short blocks in the long block that includes the current short block being processed. At block 912, the left channel attenuation factor determiner 215 determines a left channel watermark attenuation factor for the current audio band being processed by, for example, evaluating Equation 5 using the energy values determined at block 908 and 910.

In parallel with the processing performed at block 904-112, at block 914 of the example machine readable instructions 900, the right-plus-center channel audio mixer 210 of the watermark compensator 140 obtains audio samples from the right (R) and center (C) channels of a multichannel host audio signal. At block 916, the right-plus-center channel audio mixer 210 down-mixes the audio samples obtained at block 914 to form a right stereo audio signal ($R_t$), as described above. At block 918, the right channel attenuation factor determiner 220 of the watermark compensator 140 computes the energy in the current short block of mixed right and center audio samples (e.g., the right stereo audio samples) determined at block 916. At block 920, the right channel attenuation factor determiner 220 determines a maximum energy among the group of short blocks in the long block that includes the current short block being processed. At block 922, the right channel attenuation factor determiner 220 determines a right channel watermark attenuation factor for the current audio band being processed by, for example, evaluating Equation 7 using the energy values determined at block 918 and 920.

After the left channel and right channel attenuation factors for the current audio band are determined at block 912 and 922, respectively, processing proceeds to block 924 at which the center channel attenuation factor determiner 225 of the watermark compensator 140 determines a center channel watermark attenuation factor for the current audio band. For example, and as described above, the center channel attenuation factor determiner 225 can determine the center channel watermark attenuation factor for the current audio band to be the minimum of the left channel and right channel attenuation factors for the current audio band. At block 926, the watermark compensator 140 causes processing to iterate to a next audio band until left, right and center channel attenuation factors have been determined for all audio bands in which watermark code frequencies are to be embedded.

After all the left, right and center channel attenuation factors have been determined for the current audio block (e.g., short block) in which a watermark is to be embedded, processing proceeds to block 928 of FIG. 9B. At block 928, the watermark embedder 120 iterates through each audio band in which a code frequency of a watermark is to be embedded. For each audio band, at block 930 the left channel watermark attenuator 325 of the watermark embedder 120 applies the respective left channel attenuation factor to the watermark code frequency to be embedded in the current audio band of the left channel, as described above. At block 932, the left channel watermark embedder 305 of the watermark embedder 120 embeds the watermark code frequency, which was attenuated at block 930, into the left channel of the multichannel host audio signal.

In parallel with the processing at block 930 and 932, at block 934 the right channel watermark attenuator 330 of the watermark embedder 120 applies the respective right channel attenuation factor to the watermark code frequency to be embedded in the current audio band of the right channel, as described above. At block 936, the right channel watermark embedder 310 of the watermark embedder 120 embeds the watermark code frequency, which was attenuated at block 934, into the right channel of the multichannel host audio signal. Similarly, in parallel with the processing at block 934 and 936, at block 938 the center channel watermark attenuator 335 of the watermark embedder 120 applies the respective center channel attenuation factor to the watermark code frequency to be embedded in the current audio band of the center channel, as described above. At block 940, the center channel watermark embedder 315 of the watermark embedder 120 embeds the watermark code frequency, which was attenuated at block 938, into the center channel of the multichannel host audio signal.

At block 942, the watermark embedder 120 causes processing to iterate to a next audio band until all of the watermark code frequencies have been embedded in all of the respective audio bands of the left, right and center audio channels. Then, at block 944 the audio channel combiner 320 of the watermark embedder 120 combines, using any appropriate technique, the watermarked left, right and center audio channels, across all subbands, to form a watermarked multichannel audio signal. Accordingly, execution of the example machine readable instructions 900 illustrated in FIGS. 9A-9B causes the same watermark to be embedded in the different audio channels of a multichannel host audio signal, and with different attenuation factors being applied to the watermark in different audio channels.

Figure 10:
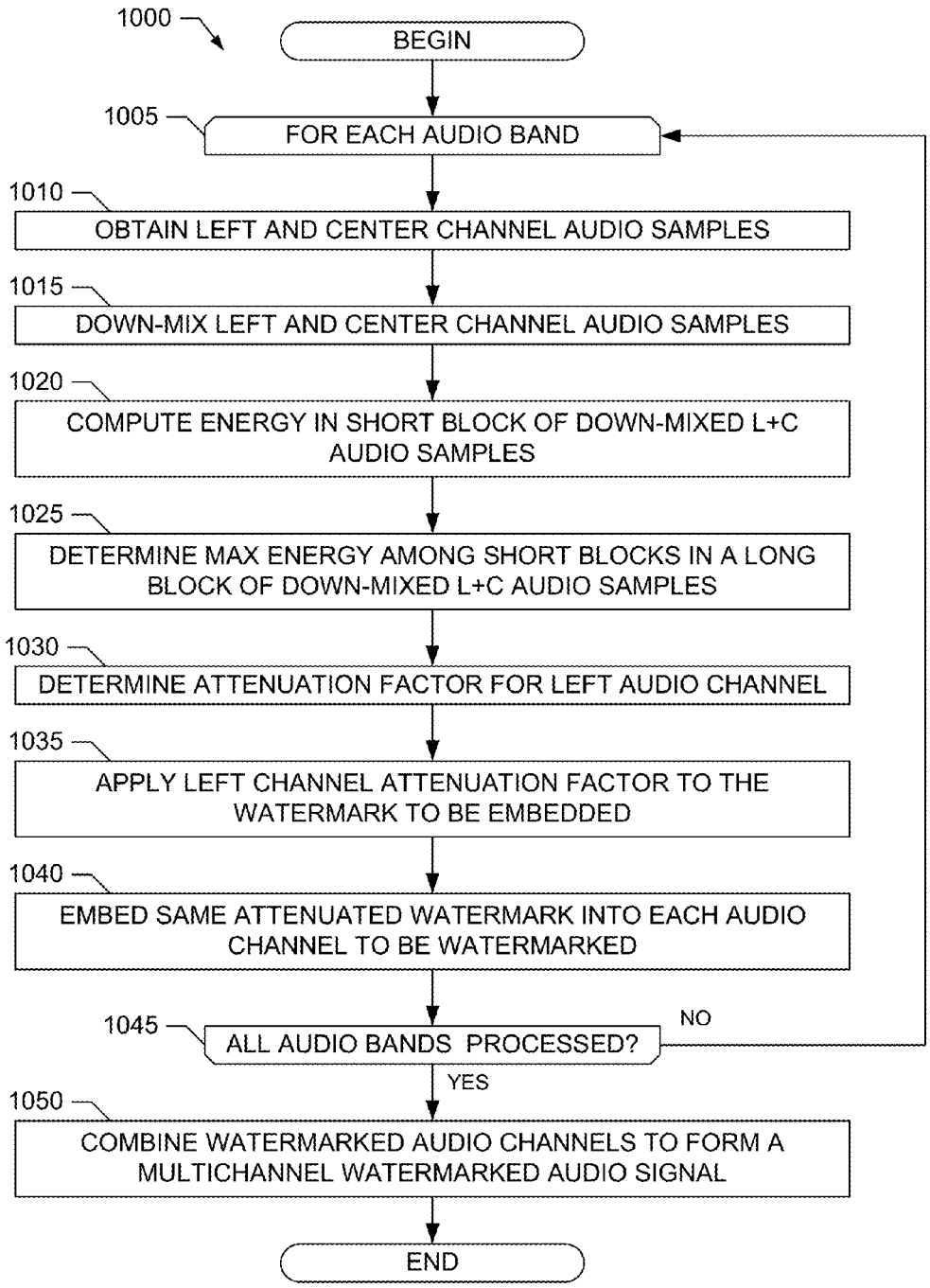
FIG. 10 is a flowchart representative of example machine readable instructions that may be executed to implement the second example watermark compensator of FIG. 4 and the second example watermark embedder of FIG. 5.

Example machine readable instructions 1000 that may be executed by the watermark compensator 140 of FIG. 4 and the example watermark embedder 120 of FIG. 5 to perform down-mixing compensation for audio watermarking in the example media monitoring system 105 of FIG. 1 are illustrated in FIG. 10. The example machine readable instructions 1000 correspond to an example implementation by the watermark compensator 140 of FIG. 4 and the watermark embedder 120 of FIG. 5 of the functionality provided by the example machine readable instructions 800 of FIG. 8. With reference to the preceding figures and associated descriptions, the example machine readable instructions 1000 of FIG. 10 begin execution at block 1005 at which the watermark compensator 140 iterates through each audio band in which a code frequency of a watermark is to be embedded, as described above. For each audio band, at block 1005 the left-plus-center channel audio mixer 205 of the watermark compensator 140 obtains audio samples from the left (L) and center (C) channels of a multichannel host audio signal. At block 1015, the left-plus-center channel audio mixer 205 down-mixes the audio samples obtained at block 1010 to form a left stereo audio signal ($L_t$), as described above. At block 1020, the left channel attenuation factor determiner 215 of the watermark compensator 140 computes the energy in the current short block of mixed left and center audio samples (e.g., the left stereo audio samples) determined at block 1015. At block 1025, the left channel attenuation factor determiner 215 determines a maximum energy among the group of short blocks in the long block that includes the current short block being processed. At block 1030, the left channel attenuation factor determiner 215 determines a left channel watermark attenuation factor for the current audio band being processed by, for example, evaluating Equation 5 using the energy values determined at block 1020 and 1025. (In some examples, the processing at blocks 1010-1030 can be modified to determine a right channel watermark attenuation factor, instead of a left channel watermark attenuation factor, by processing the audio samples from the right and center audio channels, as described above.)

At block 1035 the watermark attenuator 505 of the watermark embedder 120 applies the same respective left channel attenuation factor to the watermark code frequency to be embedded in the current audio band of each of the left, right and center channels, as described above. At block 1040, the left channel watermark embedder 305, right channel watermark embedder 310 and center channel watermark embedder 315 of the watermark embedder 120 embed the same attenuated watermark code frequency, which was attenuated at block 1035, into the left, right and center channels, respectively, of the multichannel host audio signal. At block 1045, the watermark embedder 120 and watermark compensator 140 cause processing to iterate to a next audio band until all of the attenuated watermark code frequencies have been embedded in all of the respective audio bands of the left, right and center audio channels. Then, at block 1050 the audio channel combiner 320 of the watermark embedder 120 combines, using any appropriate technique, the watermarked left, right and center audio channels, across all subbands, to form a watermarked multichannel audio signal. Accordingly, execution of the example machine readable instructions 1000 illustrated in FIG. 10 causes the same watermark to be embedded in the different audio channels of a multichannel host audio signal, and with the same attenuation factor being applied to the watermark in different audio channels.

Figure 11:
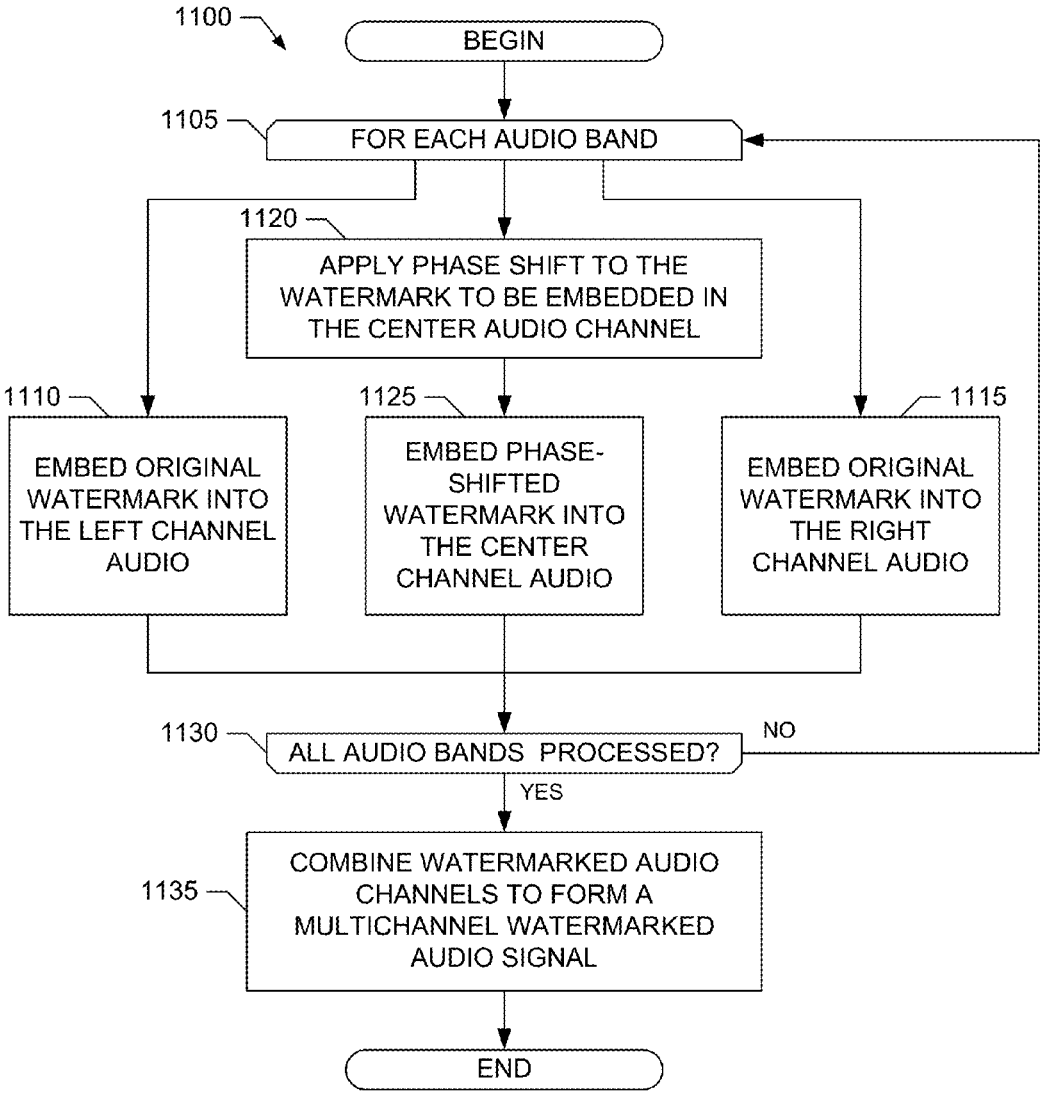
FIG. 11 is a flowchart representative of example machine readable instructions that may be executed to implement the third example watermark embedder of FIG. 6.

Example machine readable instructions 1100 that may be executed by the example watermark embedder 120 of FIG. 6 to perform down-mixing compensation for audio watermarking in the example media monitoring system 105 of FIG. 1 are illustrated in FIG. 11. The example machine readable instructions 1100 correspond to an example implementation by the watermark embedder 120 of FIG. 6 of the functionality provided by the example machine readable instructions 800 of FIG. 8. With reference to the preceding figures and associated descriptions, the example machine readable instructions 1100 of FIG. 11 begin execution at block 1105 at which the watermark embedder 120 iterates through each audio band in which a respective code frequency of a watermark is to be embedded. For each audio band, at block 1110, the left channel watermark embedder 305 of the watermark embedder 120 embeds the watermark code frequency for the current audio band into the left channel of the multichannel host audio signal. In parallel, at block 1115, the right channel watermark embedder 310 of the watermark embedder 120 embeds the watermark code frequency for the current audio band into the right channel of the multichannel host audio signal.

Furthermore, in parallel with the processing at blocks 1110 and 1115, at block 1120, the watermark phase shifter 605 of the watermark embedder 120 applies a phase shift (e.g., of 90 degrees or some other value) to the watermark code frequency for the current audio band. Also, at block 1125, the center channel watermark embedder 315 of the watermark embedder 120 embeds the phase-shifted watermark code frequency for the current audio band into the center channel of the multichannel host audio signal. At block 1130, the watermark embedder 120 causes processing to iterate to a next audio band until all of the watermark code frequencies have been embedded in all of the respective audio bands of the left, right and center audio channels. Then, at block 1135 the audio channel combiner 320 of the watermark embedder 120 combines, using any appropriate technique, the watermarked left, right and center audio channels, across all subbands, to form a watermarked multichannel audio signal. Accordingly, execution of the example machine readable instructions illustrated in FIG. 11 causes the same watermark to be embedded in the different audio channels of a multichannel host audio signal, but with the watermark having a phase offset in at least one of the audio channels.

Figure 12:
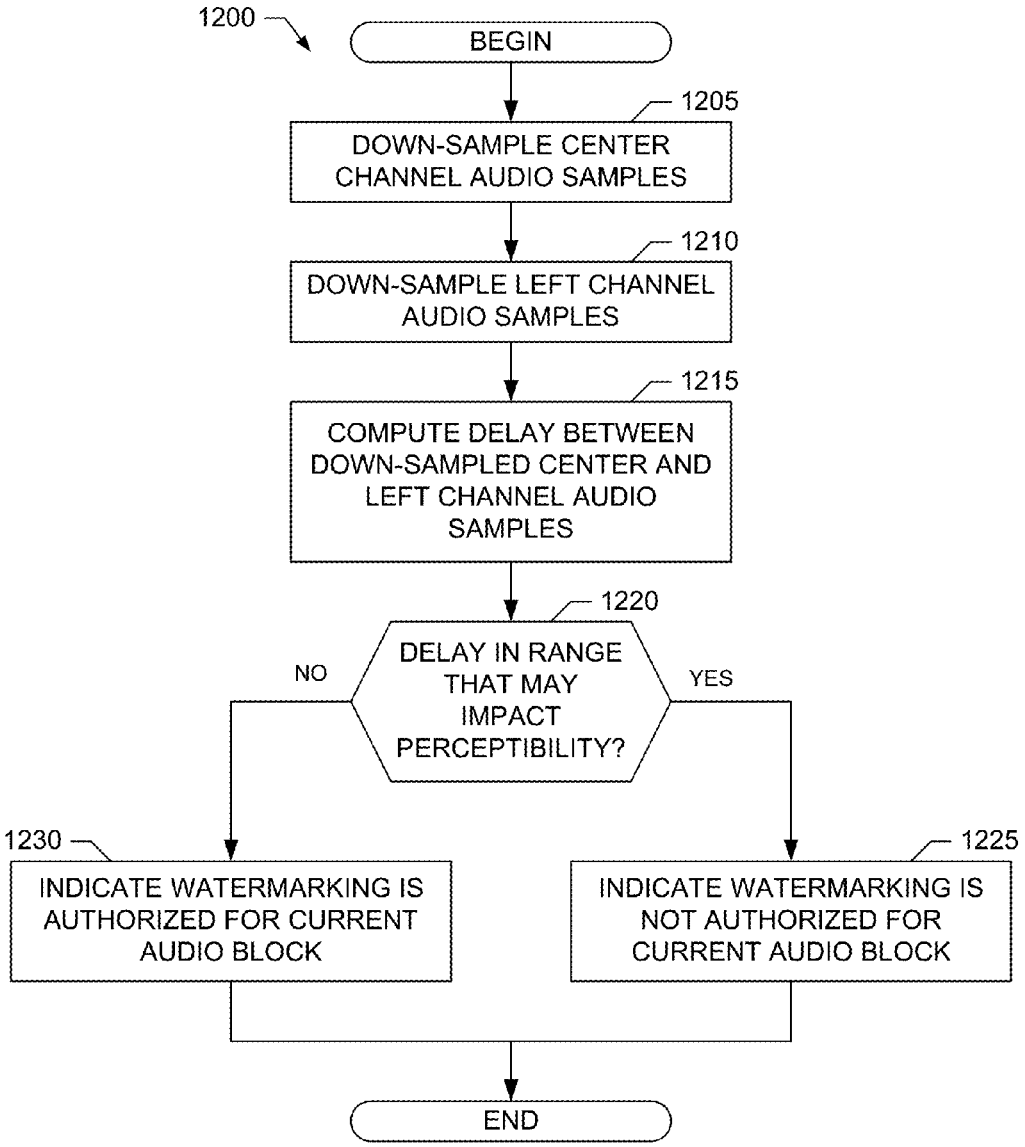
FIG. 12 is a flowchart representative of example machine readable instructions that may be executed to implement the third example watermark compensator of FIG. 7.

Example machine readable instructions 1200 that may be executed by the example watermark compensator 140 of FIG. 7 to perform down-mixing compensation for audio watermarking in the example media monitoring system 105 of FIG. 1 are illustrated in FIG. 12. The example machine readable instructions 1200 correspond to an example implementation by the watermark compensator 140 of FIG. 7 of the functionality provided by the example machine readable instructions 800 of FIG. 8. With reference to the preceding figures and associated descriptions, the example machine readable instructions 1200 of FIG. 12 begin execution at block 1205 at which the delay evaluator 705 of the watermark compensator 140 down-samples, as described above, the center channel audio samples that have been buffered for watermarking. At block 1210, the delay evaluator 705 down-samples, as described above, the left channel audio samples that have been buffered for watermarking. At block 1215, the delay evaluator 705 determines the delay between the down-sampled center and left channel audio samples obtained at blocks 1205 and 1210, respectively. For example, and as described above, the delay evaluator 705 can compute a normalized correlation between the down-sampled center and left channel audio samples to determine the delay between these audio channels.

Next, at block 1220, the watermarking authorizer 710 of the watermark compensator 140 examines the delay determined by the delay evaluator 705 at block 1215. If the delay is in a range of delays (e.g., as described above) that may impact perceptibility of the watermark after down-mixing (block 1220), then at block 1225 the watermarking authorizer 710 sets a decision indicator to indicate that audio watermarking is not authorized for the current audio block (e.g., short block or long block) due the delay between the left and center audio channels. However, if the delay is not in the range of delays (e.g., as described above) that may impact perceptibility of the watermark after down-mixing (block 1220), then at block 1230 the watermarking authorizer 710 sets a decision indicator to indicate that audio watermarking is authorized for the current audio block (e.g., short block or long block). (In some examples, the processing at blocks 1205-1215 can be modified to determine the delay to be the delay between the right and center audio channels, instead of the delay between the left and center audio channels.)

Figure 13:
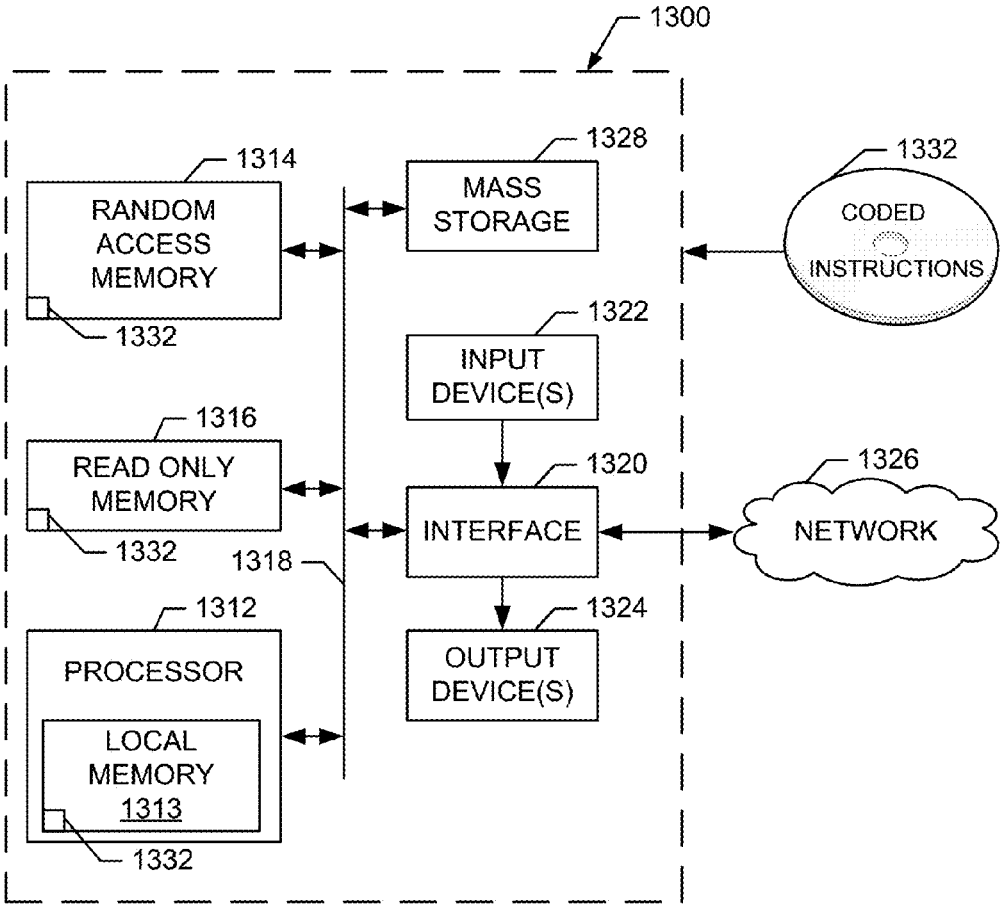
FIG. 13 is a block diagram of an example processing system that may execute the example machine readable instructions of FIGS. 8, 9A-B, 10, 11 and/or 12 to implement the first example watermark compensator of FIG. 2, the first example watermark embedder of FIG. 3, the second example watermark compensator of FIG. 4, the second example watermark embedder of FIG. 5, the third example watermark embedder of FIG. 6, the third example watermark compensator of FIG. 7 and/or the example media monitoring system of FIG. 1.

FIG. 13 is a block diagram of an example processor platform 1300 capable of executing the instructions of FIGS. 8-12 to implement the example environment of use 100, the example media monitoring system 105, the example media device 115, the example watermark embedder 120, the example watermark determiner 125, the example watermark decoder 130, the example crediting facility 135, the example watermark compensator 140, the example audio channel down-mixers 205 and/or 210, the example attenuation factor determiners 215, 220 and/or 225, the example watermark embedders 305, 310, 315 and/or 505, the example audio channel combiner 320, the example watermark attenuators 325, 330 and/or 335, the example watermark phase shifter 605, the example delay evaluator 705 and/or the example watermarking authorizer 710 of FIGS. 1-7. The processor platform 1300 can be, for example, a server, a personal computer, a mobile device (e.g., a cell phone, a smart phone, a tablet such as an iPad™), a personal digital assistant (PDA), an Internet appliance, a DVD player, a CD player, a digital video recorder, a Blu-ray player, a gaming console, a personal video recorder, a set top box, or any other type of computing device.

The processor platform 1300 of the illustrated example includes a processor 1312. The processor 1312 of the illustrated example is hardware. For example, the processor 1312 can be implemented by one or more integrated circuits, logic circuits, microprocessors or controllers from any desired family or manufacturer.

The processor 1312 of the illustrated example includes a local memory 1313 (e.g., a cache). The processor 1312 of the illustrated example is in communication with a main memory including a volatile memory 1314 and a non-volatile memory 1316 via a bus 1318. The volatile memory 1314 may be implemented by Synchronous Dynamic Random Access Memory (SDRAM), Dynamic Random Access Memory (DRAM), RAMBUS Dynamic Random Access Memory (RDRAM) and/or any other type of random access memory device. The non-volatile memory 1316 may be implemented by flash memory and/or any other desired type of memory device. Access to the main memory 1314, 1316 is controlled by a memory controller.

The processor platform 1300 of the illustrated example also includes an interface circuit 1320. The interface circuit 1320 may be implemented by any type of interface standard, such as an Ethernet interface, a universal serial bus (USB), and/or a PCI express interface.

In the illustrated example, one or more input devices 1322 are connected to the interface circuit 1320. The input device (s) 1022 permit(s) a user to enter data and commands into the processor 1312. The input device(s) can be implemented by, for example, a microphone, a camera (still or video), a keyboard, a button, a mouse, a touchscreen, a track-pad, a trackball, isopoint and/or a voice recognition system.

One or more output devices 1324 are also connected to the interface circuit 1320 of the illustrated example. The output devices 1324 can be implemented, for example, by display devices (e.g., a light emitting diode (LED), an organic light emitting diode (OLED), a liquid crystal display, a cathode ray tube display (CRT), a touchscreen, a tactile output device, a light emitting diode (LED), a printer and/or speakers). The interface circuit 1320 of the illustrated example, thus, typically includes a graphics driver card, a graphics driver chip or a graphics driver processor.

The interface circuit 1320 of the illustrated example also includes a communication device such as a transmitter, a receiver, a transceiver, a modem and/or network interface card to facilitate exchange of data with external machines (e.g., computing devices of any kind) via a network 1326

(e.g., an Ethernet connection, a digital subscriber line (DSL), a telephone line, coaxial cable, a cellular telephone system, etc.).

The processor platform 1300 of the illustrated example also includes one or more mass storage devices 1328 for storing software and/or data. Examples of such mass storage devices 1328 include floppy disk drives, hard drive disks, compact disk drives, Blu-ray disk drives, RAID systems, and digital versatile disk (DVD) drives.

The coded instructions 1332 of FIGS. 8-12 may be stored in the mass storage device 1328, in the volatile memory 1314, in the non-volatile memory 1316, and/or on a removable tangible computer readable storage medium such as a CD or DVD.

As an alternative to implementing the methods and/or apparatus described herein in a system such as the processing system of FIG. 13, the methods and or apparatus described herein may be embedded in a structure such as a processor and/or an ASIC (application specific integrated circuit).

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. An apparatus comprising:

a watermark compensator to:

determine a first attenuation factor associated with a first audio channel of a multi-channel audio signal based on first down-mixed audio samples obtained from down-mixing the first audio channel and a second audio channel of the multi-channel audio signal;

determine a second attenuation factor associated with a third audio channel of the multi-channel audio signal based on second down-mixed audio samples obtained from down-mixing the second audio channel and the third audio channel of the multi-channel audio signal; and select one of the first attenuation factor or the second attenuation factor to be a third attenuation factor associated with the second audio channel of the multi-channel audio signal; and a watermark embedder to embed a watermark in the second audio channel based on the third attenuation factor.

2. The apparatus of claim 1, wherein the first audio channel is a left audio channel, the second audio channel is a center audio channel, and the third audio channel is a right audio channel.

3. The apparatus of claim 1, wherein the watermark compensator is to select a smallest one of the first attenuation factor and the second attenuation factor to be the third attenuation factor.

4. The apparatus of claim 1, wherein the first attenuation factor is associated with a first audio band of the first audio channel, the second attenuation factor is associated with a first audio band of the third audio channel, the third attenuation factor is associated with a first audio band of the second audio channel, and the watermark compensator is further to:

determine a fourth attenuation factor associated with a second audio band of the first audio channel based on the first down-mixed audio samples obtained from down-mixing the first audio channel and the second audio channel;

determine a fifth attenuation factor associated with a second band of the third audio channel signal based on the second down-mixed audio samples obtained from down-mixing the second audio channel and the third audio channel of the multi-channel audio signal; and select one of the fourth attenuation factor or the fifth attenuation factor to be a sixth attenuation factor associated with a second audio band of the second audio channel.

5. The apparatus of claim 1, wherein the watermark compensator is to determine the first attenuation factor further based on a first ratio of a first energy to a second energy, the first energy determined from a first one of a plurality of blocks of the first down-mixed audio samples, the second energy determined from the plurality of blocks of the first down-mixed audio samples, and the watermark compensator is to determine the second attenuation factor further based on a second ratio of a third energy to a fourth energy, the third energy determined from a first one of a plurality of blocks of the second down-mixed audio samples, the fourth energy determined from the plurality of blocks of the second down-mixed audio samples.

6. The apparatus of claim 5, wherein the watermark compensator is to determine the first attenuation factor further based on the first ratio and a scale factor, and the watermark compensator is to determine the second attenuation factor further based on the second ratio and the scale factor.

7. The apparatus of claim 1, wherein the watermark embedder is to embed the watermark in the second audio channel further based on the second attenuation factor and a masking ratio.

8. A watermark embedding method comprising:

determining, by executing an instruction with a processor, a first attenuation factor associated with a first audio channel of a multi-channel audio signal based on first down-mixed audio samples obtained from down-mixing the first audio channel and a second audio channel of the multi-channel audio signal;

determining, by executing an instruction with the processor, a second attenuation factor associated with a third audio channel of the multi-channel audio signal based on second down-mixed audio samples obtained from down-mixing the second audio channel and the third audio channel of the multi-channel audio signal;

selecting, by executing an instruction with the processor, one of the first attenuation factor or the second attenuation factor to be a third attenuation factor associated with the second audio channel of the multi-channel audio signal; and embedding, by executing an instruction with the processor, a watermark in the second audio channel based on the third attenuation factor.

9. The watermark embedding method of claim 8, wherein the first audio channel is a left audio channel, the second audio channel is a center audio channel, and the third audio channel is a right audio channel.

10. The watermark embedding method of claim 8, wherein the selecting includes selecting a smallest one of the first attenuation factor and the second attenuation factor to be the third attenuation factor.

11. The watermark embedding method of claim 8, wherein the first attenuation factor is associated with a first audio band of the first audio channel, the second attenuation factor is associated with a first audio band of the third audio channel, the third attenuation factor is associated with a first audio band of the second audio channel, and further including:

determining a fourth attenuation factor associated with a second audio band of the first audio channel based on the first down-mixed audio samples obtained from down-mixing the first audio channel and the second audio channel;

determining a fifth attenuation factor associated with a second band of the third audio channel signal based on the second down-mixed audio samples obtained from down-mixing the second audio channel and the third audio channel of the multi-channel audio signal; and selecting one of the fourth attenuation factor or the fifth attenuation factor to be a sixth attenuation factor associated with a second audio band of the second audio channel.

12. The watermark embedding method of claim 8, wherein the determining of the first attenuation factor is further based on a first ratio of a first energy to a second energy, the first energy determined from a first one of a plurality of blocks of the first down-mixed audio samples, the second energy determined from the plurality of blocks of the first down-mixed audio samples, and the determining of the second attenuation factor is further based on a second ratio of a third energy to a fourth energy, the third energy determined from a first one of a plurality of blocks of the second down-mixed audio samples, the fourth energy determined from the plurality of blocks of the second down-mixed audio samples.

13. The watermark embedding method of claim 12, wherein the determining of the first attenuation factor is further based on the first ratio and a scale factor, and the determining of the second attenuation factor is further based on the second ratio and the scale factor.

14. The watermark embedding method of claim 8, wherein the embedding of the watermark is further based on the second attenuation factor and a masking ratio.

15. A non-transitory computer readable medium comprising computer readable instructions which, when executed by a processor, cause the processor to at least:

determine a first attenuation factor associated with a first audio channel of a multi-channel audio signal based on first down-mixed audio samples obtained from down-mixing the first audio channel and a second audio channel of the multi-channel audio signal;

determine a second attenuation factor associated with a third audio channel of the multi-channel audio signal based on second down-mixed audio samples obtained from down-mixing the second audio channel and the third audio channel of the multi-channel audio signal;

select one of the first attenuation factor or the second attenuation factor to be a third attenuation factor associated with the second audio channel of the multi-channel audio signal; and embed a watermark in the second audio channel based on the third attenuation factor.

16. The non-transitory computer readable medium of claim 15, wherein the first audio channel is a left audio channel, the second audio channel is a center audio channel, and the third audio channel is a right audio channel.

17. The non-transitory computer readable medium of claim 15, wherein the instructions, when executed, cause the processor to select a smallest one of the first attenuation factor and the second attenuation factor to be the third attenuation factor.

18. The non-transitory computer readable medium of claim 15, wherein the first attenuation factor is associated with a first audio band of the first audio channel, the second attenuation factor is associated with a first audio band of the third audio channel, the third attenuation factor is associated with a first audio band of the second audio channel, and the instructions, when executed, further cause the processor to:

determine a fourth attenuation factor associated with a second audio band of the first audio channel based on the first down-mixed audio samples obtained from down-mixing the first audio channel and the second audio channel;

determine a fifth attenuation factor associated with a second band of the third audio channel signal based on the second down-mixed audio samples obtained from down-mixing the second audio channel and the third audio channel of the multi-channel audio signal; and select one of the fourth attenuation factor or the fifth attenuation factor to be a sixth attenuation factor associated with a second audio band of the second audio channel.

19. The non-transitory computer readable medium of claim 15, wherein the instructions, when executed, cause the processor to determine the first attenuation factor further based on a first ratio of a first energy to a second energy, the first energy determined from a first one of a plurality of blocks of the first down-mixed audio samples, the second energy determined from the plurality of blocks of the first down-mixed audio samples, and the instructions, when executed, cause the processor to determine the second attenuation factor further based on a second ratio of a third energy to a fourth energy, the third energy determined from a first one of a plurality of blocks of the second down-mixed audio samples, the fourth energy determined from the plurality of blocks of the second down-mixed audio samples.

20. The non-transitory computer readable medium of claim 19, wherein the instructions, when executed, cause the processor to determine the first attenuation factor further based on the first ratio and a scale factor, and the instructions, when executed, cause the processor to determine the second attenuation factor further based on the second ratio and the scale factor.

* * * * *